US009410399B2

(12) United States Patent
Andersen

(10) Patent No.: US 9,410,399 B2
(45) Date of Patent: Aug. 9, 2016

(54) MULTI-ZONE CEMENTED FRACTURING SYSTEM

(71) Applicant: Weatherford Technology Holdings, LLC, Houston, TX (US)

(72) Inventor: Clayton R. Andersen, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 260 days.

(21) Appl. No.: 13/954,522

(22) Filed: Jul. 30, 2013

(65) Prior Publication Data

US 2014/0034310 A1 Feb. 6, 2014

Related U.S. Application Data

(60) Provisional application No. 61/677,911, filed on Jul. 31, 2012.

(51) Int. Cl.

| | |
|---|---|
| ***E21B 33/16*** | (2006.01) |
| ***E21B 34/14*** | (2006.01) |
| ***E21B 23/08*** | (2006.01) |
| ***E21B 43/26*** | (2006.01) |
| *E21B 34/00* | (2006.01) |

(52) U.S. Cl.

CPC ..... *E21B 34/14* (2013.01); *E21B 23/08* (2013.01); *E21B 33/16* (2013.01); *E21B 43/26* (2013.01); *E21B 2034/007* (2013.01)

(58) Field of Classification Search

CPC ..... E21B 33/16; E21B 34/12; E21B 34/14
IPC ..... E21B 33/16, 34/12, 34/14
See application file for complete search history.

(56) References Cited

U.S. PATENT DOCUMENTS

| | | | | |
|---|---|---|---|---|
| 4,436,151 | A * | 3/1984 | Callihan | E21B 33/16 166/154 |
| 5,024,273 | A | 6/1991 | Coone et al. | |
| 6,311,775 | B1 * | 11/2001 | Allamon | A61M 25/10 166/153 |
| 6,318,472 | B1 * | 11/2001 | Rogers | E21B 23/04 166/208 |
| 6,976,539 | B2 | 12/2005 | Metcalfe et al. | |

(Continued)

FOREIGN PATENT DOCUMENTS

WO 2011/134069 A1 11/2011

OTHER PUBLICATIONS

PCT International Search Report and Written Opinion for Application PCT/US2013/053077, dated Oct. 10, 2014.

(Continued)

*Primary Examiner* — William P Neuder
(74) *Attorney, Agent, or Firm* — Patterson & Sheridan, LLP

(57) ABSTRACT

A method of cementing a liner string into a wellbore includes deploying a liner string into a wellbore; pumping cement slurry into a workstring; and pumping a dart through the workstring, thereby driving the cement slurry into the liner string. The dart engages a first wiper plug and releases the first wiper plug from the workstring. The dart and engaged first wiper plug drive the cement slurry through the liner string and into an annulus formed between the liner string and the wellbore. The dart and engaged first wiper plug land onto a first fracture valve. The dart releases a first seat into the first wiper plug. The dart engages a second wiper plug connected to the first fracture valve and releases the second wiper plug from the first fracture valve.

25 Claims, 15 Drawing Sheets

(56) References Cited

U.S. PATENT DOCUMENTS

| | | | | |
|---|---|---|---|---|
| 7,066,249 | B2 | 6/2006 | Simson | |
| 7,108,067 | B2 | 9/2006 | Themig et al. | |
| 7,703,523 | B2 | 4/2010 | Wardley | |
| 7,870,907 | B2 | 1/2011 | Lembcke et al. | |
| 7,926,571 | B2 | 4/2011 | Hofman | |
| 2002/0104656 | A1 | 8/2002 | Murley et al. | |
| 2006/0065408 | A1 | 3/2006 | Green et al. | |
| 2006/0124310 | A1 | 6/2006 | Lopez de Cardenas et al. | |
| 2009/0272544 | A1* | 11/2009 | Giroux | E21B 47/122 166/382 |
| 2011/0030960 | A1 | 2/2011 | Fagley, IV et al. | |
| 2011/0192613 | A1 | 8/2011 | Garcia et al. | |
| 2011/0240311 | A1 | 10/2011 | Robison et al. | |
| 2012/0012342 | A1 | 1/2012 | Wilkin et al. | |
| 2012/0138297 | A1* | 6/2012 | Johnson | E21B 33/16 166/285 |
| 2013/0118752 | A1 | 5/2013 | Hannegan et al. | |
| 2013/0319669 | A1 | 12/2013 | DuPree et al. | |

OTHER PUBLICATIONS

Weatherford/Openhole Completions, ZoneSelect Fracturing Completion System, date 2011, pp. 1-12.

Weatherford/Openhole Completions, ZoneSelect Toe Sleeve, date 2009-2010, pp. 1-2.

Weatherford/Openhole Completions, ZoneSelect Monobore Frac Sliding Sleeve, date 2009-2011, pp. 1-2.

Weatherford/Openhole Completions, ZoneSelect MultiShift Frac Sliding Sleeve, date 2009-2011, pp. 1-4.

Weatherford/Openhole Completions, ZoneSelect SingleShot Frac Sliding Sleeve, date 2009-2012, pp. 1-3.

Weatherford/Openhole Completions, ZoneSelect MASS Frac Sliding Sleeve, date 2010-2011, pp. 1-3.

Canadian Office Action dated Feb. 12, 2016, for Canadian Patent Application No. 2,880,568.

* cited by examiner

PLC
1
1f
1r
1p
2
3
4
5
6
6a
6c
6h
6p
7c
7h
8a
8s
8w
9
10
11
12c
12t
13
14
15
15c
15f
15h
15j
15p
15s
16c
16m
17a
17b
17c
17d
18
19a
20
21
22
23
24
25c
25m
25r
26c
26m
27
30
50a
50b
50c
5d
5p
107
108

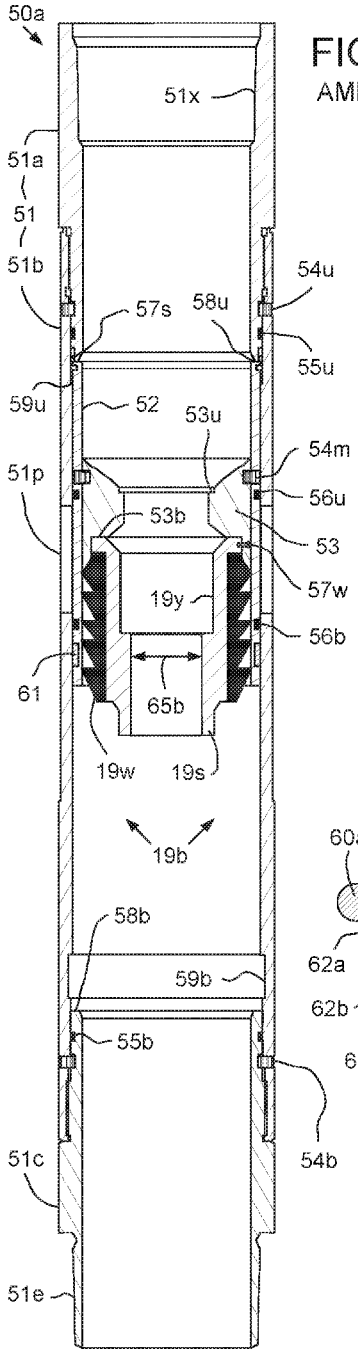
FIG. 2A
AMENDED

MULTI-ZONE CEMENTED FRACTURING SYSTEM

BACKGROUND OF THE DISCLOSURE

1. Field of the Disclosure

The present disclosure generally relates to a multi-zone cemented fracturing system.

2. Description of the Related Art

Hydraulic fracturing (aka fracing or fracking) is an operation for stimulating a subterranean formation to increase production of formation fluid, such as crude oil and/or natural gas. A fracturing fluid, such as a slurry of proppant (i.e., sand), water, and chemical additives, is pumped into the wellbore to initiate and propagate fractures in the formation, thereby providing flow channels to facilitate movement of the formation fluid into the wellbore. The fracturing fluid is injected into the wellbore under sufficient pressure to penetrate and open the channels in the formation. The fracturing fluid injection also deposits the proppant in the open channels to prevent closure of the channels once the injection pressure has been relieved.

In a staged fracturing operation, multiple zones of a formation are isolated sequentially for treatment. To achieve this isolation, a liner string equipped with multiple fracture valves is deployed into the wellbore and set into place. A first zone of the formation may be selectively treated by opening a first of the fracture valves and injecting the fracturing fluid into the first zone. Subsequent zones may then be treated by opening the respective fracture valves.

SUMMARY OF THE DISCLOSURE

The present disclosure generally relates to a multi-zone cemented fracturing system. In one embodiment, a method of cementing a liner string into a wellbore includes deploying a liner string into the wellbore to a portion of the wellbore traversing a productive formation using a workstring. The liner string includes a first fracture valve and the workstring includes a first wiper plug. The method further includes: pumping cement slurry into the workstring; and pumping a dart through the workstring, thereby driving the cement slurry into the liner string. The dart engages the first wiper plug and releases the first wiper plug from the workstring. The dart and engaged first wiper plug drive the cement slurry through the liner string and into an annulus formed between the liner string and the wellbore. The dart and engaged first wiper plug land onto the first fracture valve. The dart releases a first seat into the first wiper plug. The dart engages a second wiper plug connected to the first fracture valve and releases the second wiper plug from the first fracture valve.

In another embodiment, a fracture valve for use in a wellbore includes: a tubular housing having threaded couplings formed at each longitudinal end thereof and one or more ports formed through a wall thereof; and a sleeve disposed in the housing and releasably connected thereto in a closed position. The sleeve is longitudinally movable relative to the housing between an open position and the closed position. The sleeve covers the ports in the closed position. The sleeve exposes the ports in the open position. The valve further includes: a collar connected to the first sleeve and made from a millable material and a wiper plug releasably connected to the collar and having a first seat formed therein.

In another embodiment, a dart for use with a fracture valve system includes: a mandrel made from a millable material; one or more fins connected to the mandrel and made from an elastomer or elastomeric copolymer; and a seat stack. The seat stack includes: a lower seat fastened to the mandrel by one or more lower shearable fasteners and having an outer sealing surface and an inner sealing surface; and an upper seat fastened to the lower seat or mandrel by one or more upper shearable fasteners and having an outer sealing surface and an inner sealing surface. A shear strength of the lower shearable fasteners is greater than a shear strength of the upper shearable fasteners. An outer diameter of the upper seat is greater than an outer diameter of the lower seat. A diameter of the inner sealing surface of the upper seat is greater than a diameter of the inner sealing surface of the lower seat.

In another embodiment, a method of fracturing a productive formation includes deploying a liner string into a wellbore to a portion of the wellbore traversing the productive formation using a workstring. The liner string includes a first cluster valve and the workstring includes a first wiper plug. The method further includes: pumping cement slurry into the workstring; and pumping a dart through the workstring, thereby driving the cement slurry into the liner string. The dart engages the first wiper plug and releases the first wiper plug from the workstring. The dart and engaged first wiper plug drive the cement slurry through the liner string and into an annulus formed between the liner string and the wellbore. The dart and engaged first wiper plug land onto the first cluster valve. The first wiper plug releases the dart. The dart engages a second wiper plug connected to the first cluster valve and releases the second wiper plug from the first cluster valve. The method further includes deploying a ball through the liner string to the first cluster valve. The ball lands onto the first wiper plug and opens the cluster valve. The first wiper plug releases the ball.

A fracture valve for use in a wellbore includes: a tubular housing having threaded couplings formed at each longitudinal end thereof and one or more ports formed through a wall thereof; a sleeve disposed in the housing and releasably connected thereto in a closed position. The sleeve is longitudinally movable relative to the housing between an open position and the closed position. The sleeve covers the ports in the closed position. The sleeve exposes the ports in the open position. The valve further includes: a collar connected to the sleeve and made from a millable material; a wiper plug releasably connected to the collar; and a seat releasably connected to the wiper plug in an extended position, wherein the seat is movable relative to the wiper plug among the extended position, a first retracted position, and a second retracted position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 2A illustrates a fracture valve of FIG. 1B.

DETAILED DESCRIPTION

Figures 1A, 1B:
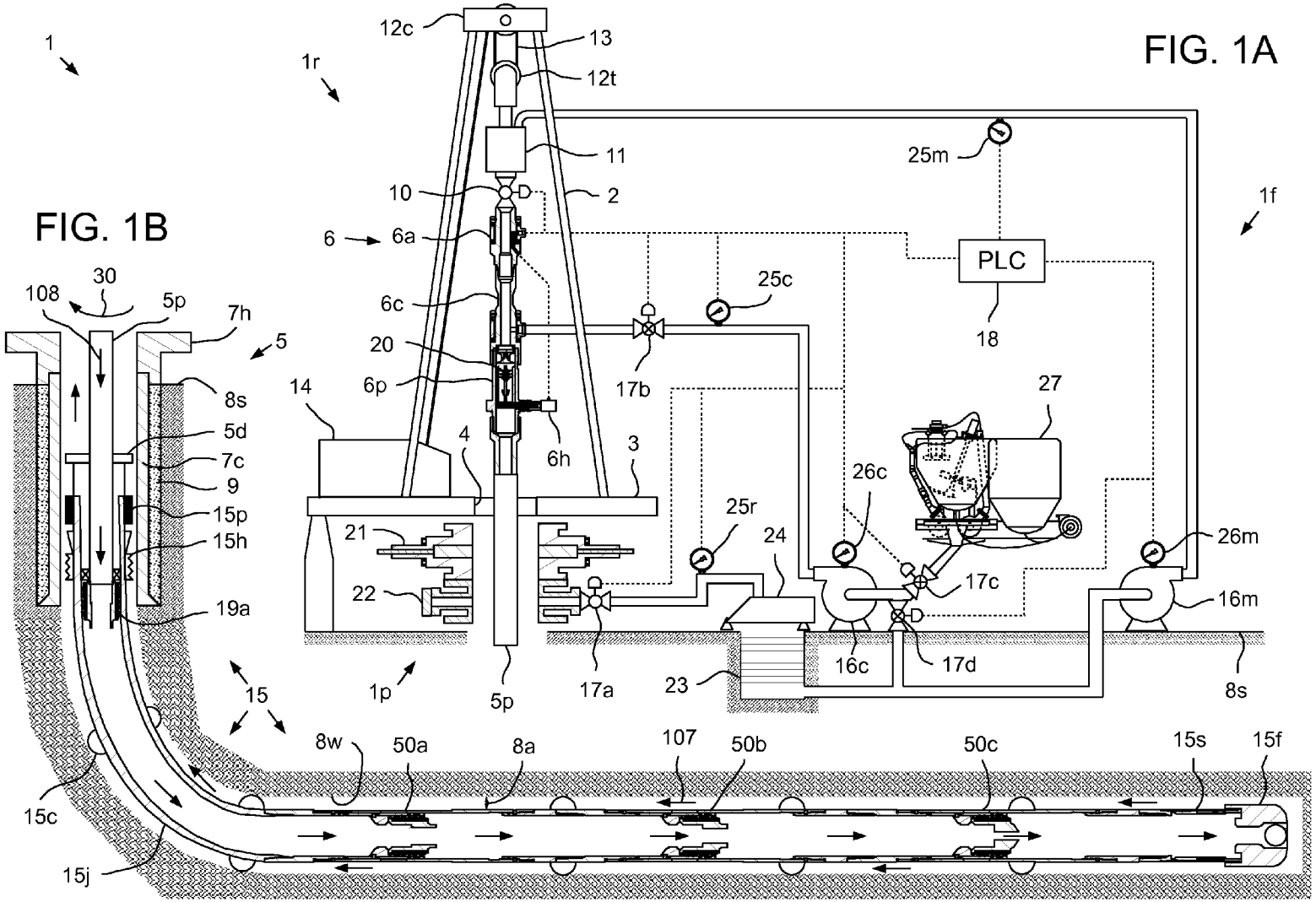
FIG. 1A illustrates a drilling system in a cementing mode, according to one embodiment of the present disclosure.
FIG. 1B illustrates a well being completed using the system.

FIG. 1A illustrates a drilling system 1 in a cementing mode, according to one embodiment of the present disclosure. FIG. 1B illustrates a well being completed using the system 1. The drilling system 1 may include a drilling rig 1*r*, a fluid system 1*f*, and a pressure control assembly (PCA) 1*p*. The drilling rig 1*r* may include a derrick 2 with a rig floor 3 at its lower end having an opening 4 through which a workstring 5 extends downwardly through the PCA 1*p*. The PCA 1*p* may be connected to a wellhead 7*h*. The wellhead 7*h* may be mounted on a casing string 7*c* which has been deployed into a wellbore 8*w* drilled from a surface 8*s* of the earth and cemented 9 into the wellbore. The wellbore 8*w* may include a vertical portion and a deviated, such as horizontal, portion. The workstring 5 may also be connected to a cementing head 6. The cementing head 6 may also be connected to a Kelly valve 10.

The Kelly valve 10 may be connected to a quill of a top drive 11. A housing of the top drive 11 may be suspended from the derrick 2 by a traveling block 12*t*. The traveling block 12*t* may be supported by wire rope 13 connected at its upper end to a crown block 12*c*. The wire rope 13 may be woven through sheaves of the blocks 12*t,c* and extend to drawworks 14 for reeling thereof, thereby raising or lowering the traveling block 12*t* relative to the derrick 2. Alternatively, a Kelly and rotary table (not shown) may be used instead of the top drive 11.

The workstring 5 may include a liner deployment assembly (LDA) 5*d* and a deployment string, such as joints of drill pipe 5*p* connected together, such as by threaded couplings. An upper end of the LDA 5*d* may be connected a lower end of the drill pipe 9*p*, such as by threaded couplings. The LDA 5*d* may releasably connect a liner string 15 to the workstring 5. The LDA 5*d* may include a diverter valve, a junk bonnet, a setting tool, a running tool, a stinger, a packoff, a spacer, a release, a plug release system, and a cementing plug, such as wiper plug 19*a*. The plug release system may releasably connect the wiper plug 19*a* to the LDA spacer.

The cementing head 6 may include an actuator swivel 6*a*, a cementing swivel 6*c*, and a launcher 6*p*. Each swivel 6*a,c* may include a housing torsionally connected to the derrick 2, such as by bars, wire rope, or a bracket (not shown). Each torsional connection may accommodate longitudinal movement of the respective swivel 6*a,c* relative to the derrick 2. Each swivel 6*a,c* may further include a mandrel and bearings for supporting the housing from the mandrel while accommodating relative rotation therebetween.

The cementing swivel 6*c* may further include an inlet formed through a wall of the housing and in fluid communication with a port formed through the mandrel and a seal assembly for isolating the inlet-port communication. The cementing swivel inlet may be connected to a cementing pump 16*c* via shutoff valve 17*b*. The shutoff valve 17*b* may be automated and have a hydraulic actuator (not shown) operable by a rig controller, such as a programmable logic controller (PLC) 18, via fluid communication with a hydraulic power unit (HPU) (not shown). Alternatively, the shutoff valve actuator may be pneumatic or electric. The cementing mandrel port may provide fluid communication between a bore of the cementing head 6 and the housing inlet.

The actuator swivel 6*a* may be hydraulic and may include a housing inlet formed through a wall of the housing and in fluid communication with a passage formed through the mandrel, and a seal assembly for isolating the inlet-passage communication. Each seal assembly may include one or more stacks of V-shaped seal rings, such as opposing stacks, disposed between the mandrel and the housing and straddling the inlet-port interface. Alternatively, the seal assembly may include rotary seals, such as mechanical face seals. The passage may extend to an outlet of the mandrel for connection to a hydraulic conduit for operating a hydraulic actuator 6*h* of the cementing head 6. The actuator swivel 6*a* may be in fluid communication with the HPU. Alternatively, the actuator swivel and cementing head actuator may be pneumatic or electric. The Kelly valve 10 may also be automated and include a hydraulic actuator (not shown) operable by the PLC 18 via fluid communication with the HPU. The cementing head 6 may further include an additional actuator swivel (not shown) for operation of the Kelly valve 10 or the top drive 11 may include the additional actuator swivel. Alternatively, the Kelly valve actuator may be electric or pneumatic.

The launcher 6*p* may include a housing, a diverter, a canister, a latch, and the actuator 6*h*. The housing may be tubular and may have a bore therethrough and a coupling formed at each longitudinal end thereof, such as threaded couplings. Alternatively, the upper housing coupling may be a flange. To facilitate assembly, the housing may include two or more sections (three shown) connected together, such as by a threaded connection. The housing may also serve as the cementing swivel housing (shown) or the launcher and cementing swivel 6*c* may have separate housings (not shown). The housing may further have a landing shoulder formed in an inner surface thereof. The canister and diverter may each be disposed in the housing bore. The diverter may be connected to the housing, such as by a threaded connection. The canister may be longitudinally movable relative to the housing. The canister may be tubular and have ribs formed along and around an outer surface thereof. Bypass passages may be formed between the ribs. The canister may further have a landing shoulder formed in a lower end thereof corresponding to the housing landing shoulder. The diverter may be operable to deflect cement slurry 109 or displacement fluid 110 away from a bore of the canister and toward the bypass passages. A cementing plug, such as dart 20, may be disposed in the canister bore for selective release and pumping downhole to activate the wiper plug 19*a*. Alternatively, the wiper plug 19*a* may be omitted.

The latch may include a body, a plunger, and a shaft. The body may be connected to a lug formed in an outer surface of the launcher housing, such as by a threaded connection. The plunger may be longitudinally movable relative to the body and radially movable relative to the housing between a capture position and a release position. The plunger may be moved between the positions by interaction, such as a jackscrew, with the shaft. The shaft may be longitudinally connected to and rotatable relative to the body. The actuator 6*h* may be a hydraulic motor operable to rotate the shaft relative to the body. Alternatively, the actuator may be linear, such as a piston and cylinder. Alternatively, the actuator may be electric or pneumatic. Alternatively, the actuator may be manual, such as a handwheel.

In operation, the PLC 18 may release the dart 20 by operating the HPU to supply hydraulic fluid to the actuator 6*h* via the actuator swivel 6*a*. The actuator 6*h* may then move the plunger to the release position (not shown). The canister and dart 20 may then move downward relative to the housing until the landing shoulders engage. Engagement of the landing shoulders may close the canister bypass passages, thereby forcing displacement fluid 110 to flow into the canister bore. The displacement fluid 110 may then propel the dart 20 from the canister bore into a lower bore of the housing and onward through the drill pipe 5*p* to the wiper 19*a*.

The PCA 1*p* may include a blow out preventer (BOP) 21, a flow cross 22, and a shutoff valve 17*a*. Each component of the PCA 1*p* may be connected together and the PCA may be connected to the wellhead 7*h*, such as by flanges and studs or bolts and nuts. The casing string 7*c* may extend to a depth adjacent a bottom of an upper formation and the liner string 15 may extend into a portion of the wellbore 8*w* traversing a lower formation. The upper formation may be non-productive and the lower formation may be a hydrocarbon-bearing reservoir.

The liner string 15 may include a plurality of liner joints 15*j* connected to each other, such as by threaded connections, one or more centralizers 15*c* spaced along the liner string at regular intervals, one or more fracture valves 50*a-c*, a toe sleeve 15*s*, a float shoe 15*f*, a liner hanger 15*h*, a packer 15*p*, and a polished bore receptacle (not shown). The liner hanger 15*h* may be operable to engage the casing 7*c* and longitudinally support the liner string 15 from the casing 7*c*. The liner hanger 15*h* may include slips and a cone. The liner hanger 15*h* may accommodate relative rotation between the liner string 15 and the casing 7*c*, such as by including a bearing (not shown). The packer 15*p* may be operable to radially expand into engagement with an inner surface of the casing 7*c*, thereby isolating the liner-casing interface. The liner hanger 15*h* and packer 15*p* may be independently set using the LDA 5*d*. Each liner joint 15*j* may be made from a metal or alloy, such as steel, stainless steel, or a nickel-based alloy. The centralizers 15*c* may be fixed or sprung. The centralizers 15*c* may engage an inner surface of the casing 7*c* and/or wellbore 8*w*. The centralizers 15*c* may operate to center the liner string 15 in the wellbore 8*w*. Alternatively, the centralizers 15*c* may be omitted.

The shoe 15*f* may be disposed at the lower end of the liner string 15 and have a bore formed therethrough. The shoe 15*f* may be convex for guiding the liner string 15 toward the center of the wellbore 8*w*. The shoe 15*f* may minimize problems associated with hitting rock ledges or washouts in the wellbore 8*w* as the liner string 15 is lowered into the wellbore 8*w*. An outer portion of the shoe 15 may be made from the liner joint material, discussed above. An inner portion of the shoe 15 may be made of a drillable or millable material, such as cement, cast iron, non-ferrous metal or alloy, engineering polymer, or fiber reinforced composite, so that the inner portion may be drilled through if the wellbore 8*w* is to be further drilled. The shoe 15*f* may include a check valve for selectively sealing the shoe bore. The check valve maybe operable to allow fluid flow from the liner bore into the wellbore 8*w* and prevent reverse flow from the wellbore into the liner bore.

The toe sleeve 15*s* may include a housing and a piston. The housing and piston may be made from any of the liner joint materials, discussed above. The housing may be tubular, have a bore formed therethrough, and have couplings, such as a threaded pin and a threaded box, formed at longitudinal ends thereof for connection to other components of the liner string 15. The housing may also have one or more flow ports formed through a wall thereof for providing fluid communication between the housing bore and the annulus 8*a*. To facilitate manufacture and assembly, the housing may include two or more sections connected together, such as by threaded connections and fasteners, such as set screws and sealed, such as by o-rings. The piston may be disposed in the housing bore and be longitudinally movable relative thereto subject to engagement with upper and lower shoulders of the housing. The piston may be releasably connected to the housing in a closed position (shown). The releasable connection may be a shearable fastener, such as one or more shear screws. The piston may cover the flow ports in the closed position and a piston-housing interface may be sealed, such as by seals carried by the piston and spaced longitudinally there-along to straddle the flow ports in the closed position. The piston may also carry a fastener, such as a C-ring, adjacent a lower end thereof for engaging a complementary profile, such as a groove, formed in an inner surface of the housing.

Figures 5A, 5B:
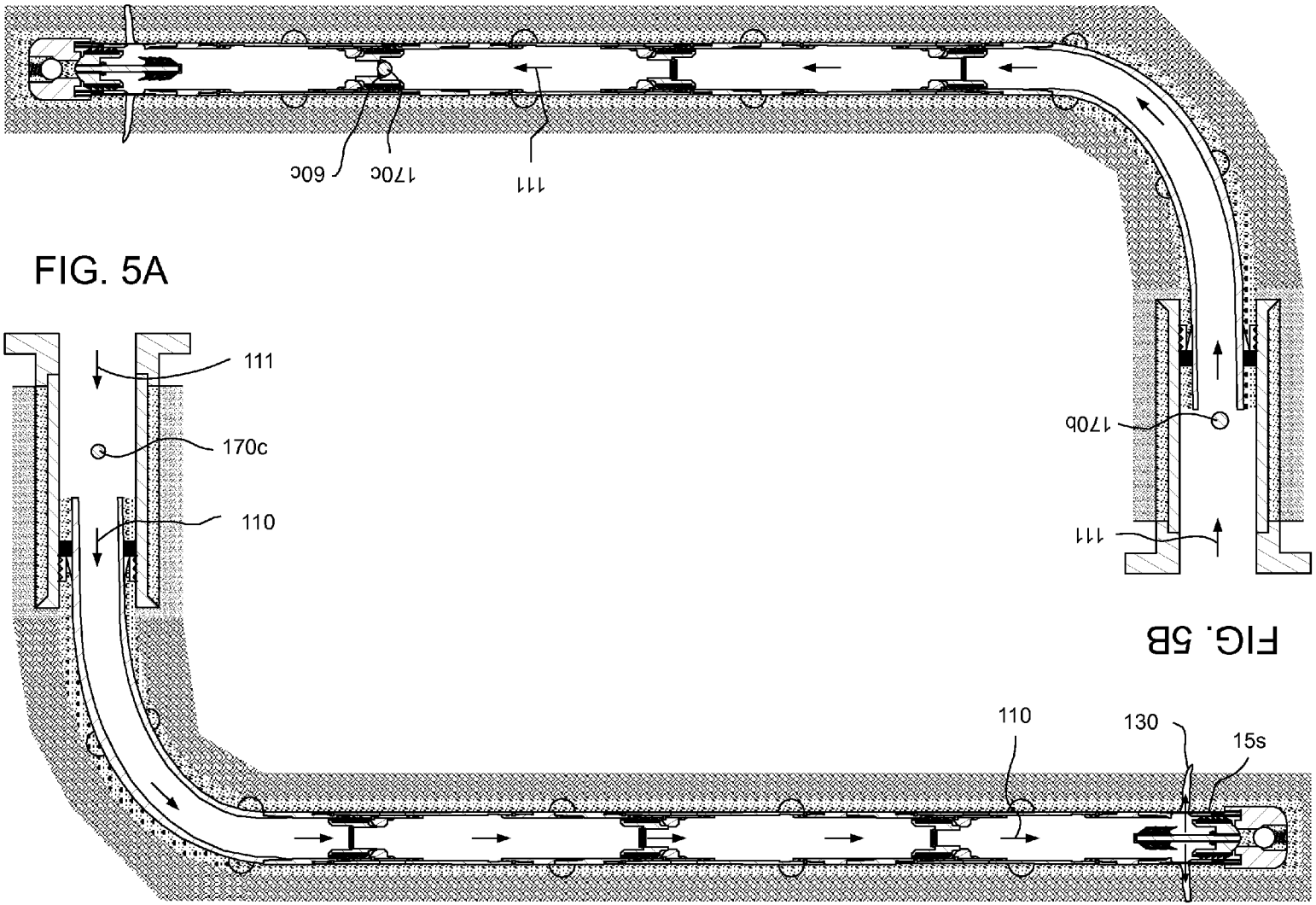
FIGS. 5A-5E illustrate a fracturing operation performed using the system.

A hydraulic chamber may be formed between the piston and the housing. The hydraulic chamber may be in fluid communication with an annulus 8*a* (formed between an inner surface of the casing 7*c* and wellbore 8*w* and an outer surface of the workstring 5 and liner string 15) via the flow ports. The piston may have an enlarged inner shoulder exposed to the housing bore and an outer shoulder exposed to the hydraulic chamber. The piston may be operated by fluid pressure in the housing bore exceeding fluid pressure in the annulus 8*a* by a substantial differential sufficient to fracture the shear screws. Once released from the housing, the piston may move downward relative to the housing until a bottom of the piston engages the lower housing shoulder, thereby exposing the flow ports to the housing bore (FIG. 5A). As the piston is nearing the open position, the C-ring may engage the groove, thereby locking the piston in the open position.

The fluid system if may include one or pumps 16*c,m*, one or more shutoff valves 17*b-d*, a drilling fluid reservoir, such as a pit 23 or tank, a solids separator, such as a shale shaker 24, one or more sensors, such as one or more pressure sensors 25*m,c,r* one or more stroke counters 26*m,c*, and a cement mixer, such as a recirculating mixer 27. The fluid system if may further include one or more flow lines, such as a mud line connecting a mud pump 16*m* to the top drive 11, a cement line connecting a cement pump 16*c* to the cementing swivel 6*c*, a return line connecting the flow cross 22 to the shale shaker 24, a mud supply line connecting the pit 23 to the pumps 16*c,m*, and a cement supply line connecting the mixer 27 to the cement pump. The cement slurry 109 (FIG. 3B) may be formulated to resist flash setting due to multiple releases of the wiper plugs and dart seats.

The valve 17*a* and pressure sensor 25*r* may be assembled as part of the return line. The valve 17*b* and pressure sensor 25*c* may be assembled as part of the cement line. The valve 17*c* may be assembled as part of the cement supply line. The valve 17*d* may be assembled as part of the mud supply line. The pressure sensor 25*m* may be assembled as part of the mud line. Each sensor 25*m,c,r*, 26*m,c* may be in data communication with the PLC 18. The pressure sensor 25*r* may be operable to monitor wellhead pressure. The pressure sensor 25*m* may be operable to measure standpipe pressure. The stroke counter 26*m* may be operable to measure a flow rate of the mud pump 16*m*. The pressure sensor 25*c* may be operable to measure discharge pressure of the cement pump 16*c*. The stroke counter 26*c* may be operable to measure a flow rate of the cement pump 16*c*.

To prepare for the cementing operation, a conditioner 108 may be circulated by the mud pump 16*m*. The conditioner 108 may flow from the mud pump 16*m*, through the standpipe and a Kelly hose to the top drive 11. The conditioner 108 may continue from the top drive 11 into the workstring 5 via the Kelly valve 10 and cementing head 6. The conditioner 108 may continue down the liner string bore and exit the shoe 15*f*. The conditioner 108 may flush drilling fluid, such as mud 107, up the annulus 8*a*. The displaced mud 107 may exit from the annulus 8*a*, through the wellhead 7*h*, and to the shaker 24 via the flow cross 22 and the valve 17*a*. The displaced mud 107 may then be processed by the shale shaker 24 and discharged into the pit 23 for storage. The conditioner 108 may also wash cuttings and/or mud cake from the wellbore 8*w* and/or adjust pH in the wellbore for pumping the cement slurry 109. Alternatively, the conditioner 108 may be pumped by the cement pump 16*c* through the valve 17*b*. The workstring 5 and liner 15 may also be rotated 30 from the surface 8*s* by the top drive 11 during circulation of the conditioner 108.

FIG. 2A illustrates the fracture valve 50*a*. The fracture valve 50*a* may include a housing 51, a sleeve 52, a collar 53, and a cementing plug, such as wiper plug 19*b*. The housing 51 and sleeve 52 may be made from any of the liner joint materials, discussed above. The housing 51 may be tubular, have a bore formed therethrough, and have couplings, such as a threaded pin 51*e* and a threaded box 51*b*, formed at longitudinal ends thereof for connection to other components of the liner string 15. The housing 51 may also have one or more fracturing ports 51*p* formed through a wall thereof for providing fluid communication between the housing bore and the annulus 8*a*. To facilitate manufacture and assembly, the housing 51 may include two or more sections 51*a-c* connected together, such as by threaded connections and fasteners, such as set screws 54*u,b*, and sealed, such as by o-rings 55*u,b*.

The sleeve 52 may be disposed in the housing bore and be longitudinally movable relative thereto subject to engagement with upper 58*u* and lower 58*b* shoulders of the housing 51. The shoulders 58*u,b* may be formed by longitudinal ends of the respective housing sections 51*a,c*. The sleeve 52 may be releasably connected to the housing 51 in a closed position (shown). The releasable connection may be a shearable fastener, such as shear ring 57*s*. The shear ring 57*s* may have a stem portion disposed in a recess 59*u* formed in an inner surface of the housing 51 adjacent the upper shoulder 58*u* and a lip portion extending into a groove formed in the outer surface of the sleeve 52. The sleeve 52 may cover the ports 51*p* in the closed position and a sleeve-housing interface may be sealed, such as by seals 56*u,b* carried by the sleeve and spaced longitudinally there-along to straddle the ports 51*p* in the closed position. The seals 56*u,b* may each be single element or seal stacks, as discussed above.

The sleeve 52 may also carry a fastener, such as a C-ring 61, adjacent a lower end thereof for engaging a complementary profile, such as a groove 59*b*, formed in an inner surface of the housing 51 adjacent the lower shoulder 58*b*. Once released from the housing 51, the sleeve 52 may move downward relative to the housing until a bottom of the sleeve engages the lower shoulder 58*b*, thereby exposing the ports 51*p* to the housing bore (FIG. 5E). As the sleeve 52 is nearing the open position, the C-ring 61 may engage the groove 59*b*, thereby locking the sleeve in the open position.

The collar 53 may be disposed in a bore of the sleeve 52 and connected, such as longitudinally and torsionally, thereto, such as by one or more fasteners (i.e., set screws 54*m*). The collar 53 may be made from any of the millable/drillable materials, discussed above. The collar 53 may be annular and have a bore formed therethrough. The collar 53 may have a landing shoulder 53*u* and a mounting shoulder 53*b*, each shoulder formed in an inner surface thereof. The mounting shoulder 53*b* may be mated with a top of the wiper plug 19*b*.

The wiper plug 19*b* may have a body 19*y* and a wiper seal 19*w*. The body 19*y* may be annular and have a bore formed therethrough. The body 19*y* may have a seat formed in an inner surface thereof, a mounting shoulder formed in an outer surface thereof, and a stinger portion 19*s* forming a lower end thereof for landing in the collar (see collar 53) of the adjacent fracture valve 50*b*. The wiper seal 19*f* may be molded, bonded, or fastened onto an outer surface of the body 19*y* and seated against the mounting shoulder. The wiper seal 19*f* may be made from an elastomer or elastomeric copolymer. The wiper plug 19*b* may be releasably connected to the collar 53 and seated against the mounting shoulder 53*b*. The releasable connection may include a set 57*w* of one or more (one shown) shearable fasteners, such as shear screws.

Figure 2B:
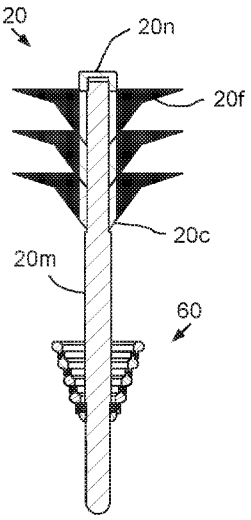
FIG. 2B illustrates a dart of FIG. 1A.
Figure 2C:
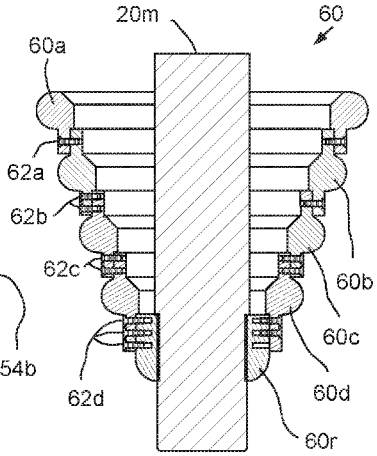
FIG. 2C illustrates a seat stack of the dart.
Figure 2D:
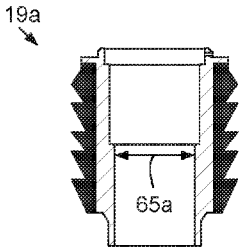
FIGS. 2D-2F illustrate wiper plugs of FIG. 1B.
Figure 2E:
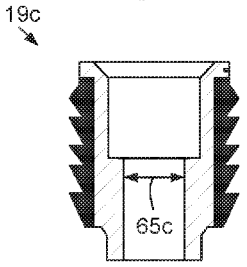
Figure 2F:
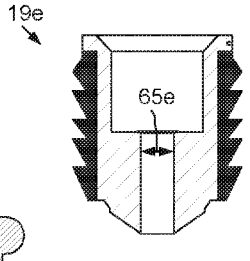
Figure 2G:
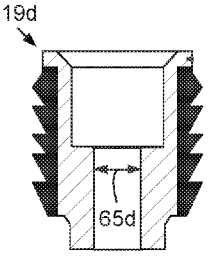
FIG. 2G illustrates an additional wiper plug usable with a liner string of FIG. 1B.

FIGS. 2D-2F illustrate wiper plugs 19*a,c,e* of the LDA plug release system/fracture valves 50*b-c*. FIG. 2G illustrates an additional wiper plug 19*d* usable with the liner string 15. The wiper plug 19*a* may be identical to the wiper plug 19*b* except for having a seat diameter 65*a* greater than a seat diameter 65*b* of the wiper plug 19*b* and having a slight modification for connection to the LDA plug release system. The wiper plug 19*c* may be identical to the wiper plug 19*b* except for having a seat diameter 65*c* less than the seat diameter 65*b*. The wiper plug 19*d* may be identical to the wiper plug 19*b* except for having a seat diameter 65*d* less than the seat diameter 65*c*. The wiper plug 19*e* may be identical to the wiper plug 19*b* except for having a seat diameter 65*e* less than the seat diameter 65*d* and having a landing shoulder for engagement with the shoe 15*f* instead of the stinger portion 19*s*.

The other fracture valves 50*b,c* may each be identical to the fracture valve 50*a* except for the substitution of the wiper plug 19*c* for the wiper plug 19*b* in the valve 50*b* and the substitution of the wiper plug 19*e* for the wiper plug 19*b* in the valve 50*c*. The liner string 15 may further include an additional fracture valve (not shown) disposed between the fracture valves 50*b,c* identical to the fracture valve 50*a* except for the substitution of the wiper plug 19*d* for the wiper plug 19*b*.

FIG. 2B illustrates the dart 20. FIG. 2C illustrates a seat stack 60 of the dart. The dart 20 may include a mandrel 20*m*, a fin stack 20*c,f*, and the seat stack 60. The fin stack 20*c,f* may include one or more (three shown) fins 20*f*, each fin bonded, molded, or fastened to an outer surface of a respective fin collar 20*c*. Each fin 20*f* may be made from an elastomer or elastomeric copolymer. An outer surface of the mandrel 20*m* may have an upper mounting shoulder for receiving the fin collars 20*c* and an upper thread for receiving a fastener, such as a threaded nut 20*n*, thereby connecting the fin stack 20*c,f* to the mandrel. The mandrel 20*m*, seat stack 60, fin collar 20*c*, and nut 20*n* may be made from any of the millable/drillable materials, discussed above.

The seat stack 60 may include one or more seats 60*a-d* and a retainer 60*r*. A top seat 60*a* of the stack 60 may be releasably connected to a first intermediate seat 60*b* of the stack 60. The releasable connection may include a set 62*a* of one or more (two shown) shearable fasteners, such as shear screws. The first intermediate seat 60*b* of the stack 60 may also be releasably connected to a second intermediate seat 60*c* of the stack 60. The releasable connection may include a set 62*b* of one or more (three shown) shearable fasteners, such as shear screws. The second intermediate seat 60*c* of the stack 60 may also be releasably connected to a bottom seat 60*d* of the stack 60. The releasable connection may include a set 62*c* of one or more (four shown) shearable fasteners, such as shear screws. A bottom seat 60*d* of the stack 60 may also be releasably connected to the retainer 60*r*. The releasable connection may include a set 62*d* of one or more (five shown) shearable fasteners, such as shear screws.

A shear strength of each set 62*a-d* of shearable fasteners may be greater or substantially greater than a shear strength of each set 57*w* of shearable fasteners. A shear strength of the shear ring 57*s* may be greater or substantially greater than the shear strength of each set 62*a-d* of shearable fasteners and may be greater or substantially greater than the shear strength of each set 57*w* of shearable fasteners. The shear strength of the bottom set 62*d* of shearable fasteners may also be greater or substantially greater than the shear strength of the second intermediate set 62*c* of shearable fasteners. The shear strength of the second intermediate set 62*c* of shearable fasteners may also be greater or substantially greater than the shear strength of the first intermediate set 62*b* of shearable fasteners. The shear strength of the first intermediate set 62*b* of shearable fasteners may also be greater or substantially greater than the shear strength of the top set 62*a* of shearable fasteners.

Each seat 60*a-d* may have an outer seating surface for engagement with a seat of the respective wiper plug 19*a-c*, 19*d* and an inner seating surface for receiving a respective pump-down plug, such as balls 170*a-c* (FIG. 4) (ball for seat 20*d* not shown). The top seat 60*a* may have an outer diameter greater than an outer diameter of each successive seat 60*b-d* (and the retainer 60*r*) and corresponding to the seat diameter 65*a* such that the top seat may engage the seat of the wiper plug 19*a*. The successive seats 60*b-d* (and the retainer 60*r*) may each have an outer diameter less than the seat diameter 65*a* such that the rest of the seats 60*b-d* may pass through the wiper plug seat unobstructed. The first intermediate seat 60*b* may have an outer diameter greater than an outer diameter of each successive seat 60*c-d* (and the retainer 60*r*) and corresponding to the seat diameter 65*b* such that the first intermediate seat may engage the seat of the wiper plug 19*b*. The successive seats 60*c-d* (and the retainer 60*r*) may each have an outer diameter less than the seat diameter 65*b* such that the rest of the seats 60*c-d* may pass through the wiper plug seat unobstructed. The second intermediate seat 60*c* may have an outer diameter greater than an outer diameter of the bottom seat 60*d* (and the retainer 60*r*) and corresponding to the seat diameter 65*c* such that the second intermediate seat may engage the seat of the wiper plug 19*c*.

The bottom seat 60*d* (and the retainer 60*r*) may each have an outer diameter less than the seat diameter 65*c* such that the bottom seat 60*d* may pass through the wiper plug seat unobstructed. The bottom seat 60*d* may have an outer diameter greater than an outer diameter of the retainer 60*r* and corresponding to the seat diameter 65*d* such that the bottom seat may engage the seat of the wiper plug 19*d*. The retainer 60*r* may have an outer diameter less than the seat diameter 65*d* such that the retainer 60*r* may pass through the wiper plug seat unobstructed. The retainer 60*r* may have an outer seating surface and a threaded inner surface and the outer surface of the mandrel 20*m* may have a lower shouldered thread for receiving the retainer 20*r*, thereby connecting the seat stack 60 to the mandrel 20*m*. A bottom of the retainer 60*r* may form a seat having an outer diameter corresponding to the seat diameter 65*e* such that the retainer seat may engage the seat of the wiper plug 19*e*.

Figures 3A, 3B:
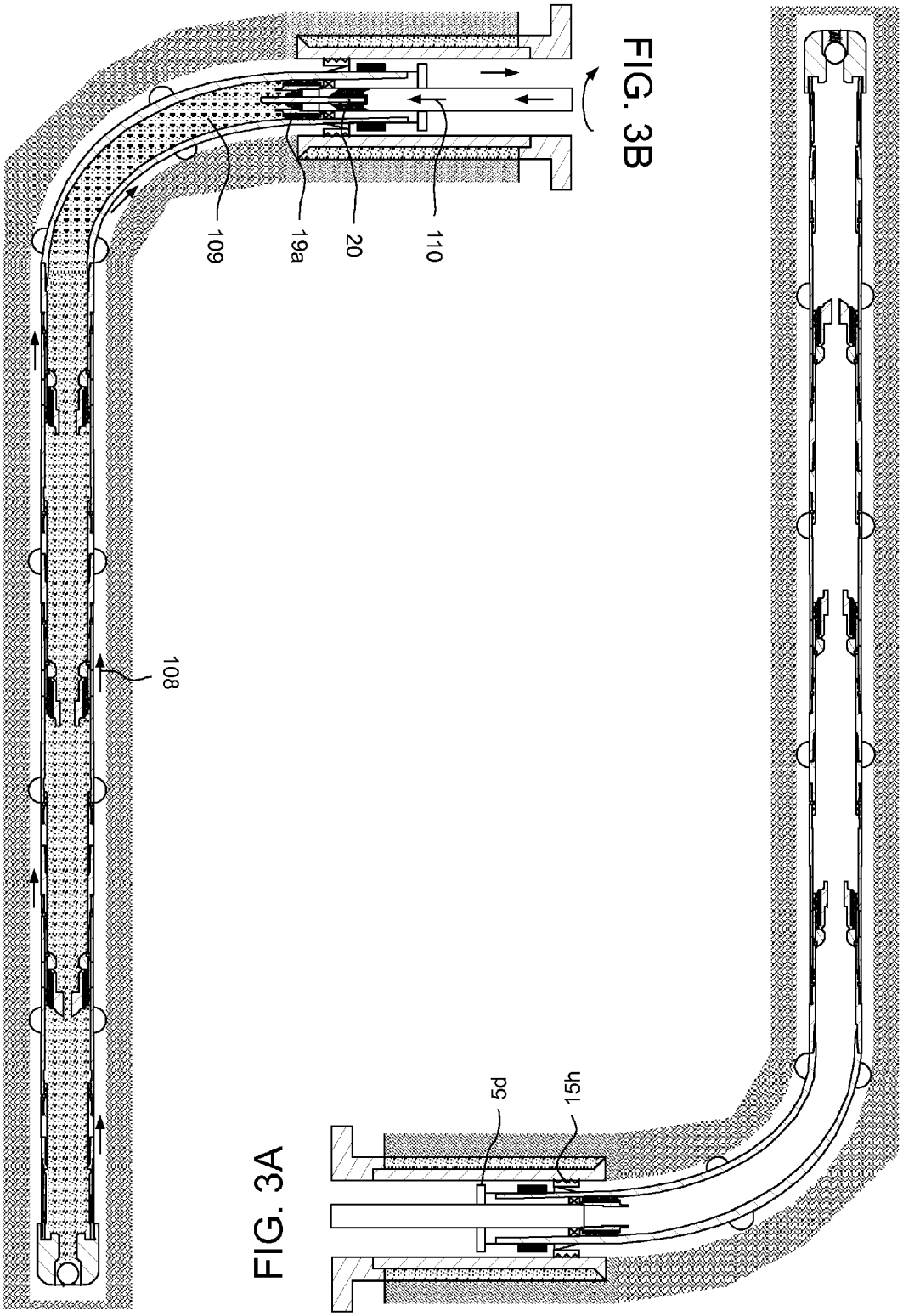
FIGS. 3A-3J illustrate a cementing operation performed using the system.

FIGS. 3A-3J illustrate a cementing operation performed using the system 1. Referring specifically to FIG. 3A, rotation 30 may be halted and the LDA 5*d* may be operated to set the liner hanger 15*h* mechanically by articulation of the workstring 5 or hydraulically by pumping a setting plug, such as a ball (not shown), through the deployment string to a seat of the LDA 5*d*. Alternatively, the liner hanger 15*h* may be set using a control line (not shown) extending along the workstring to the actuator swivel 6*a*. Once the liner hanger 15*h* has been set, the LDA running tool may be operated to release the liner string 15 therefrom. Setting of the liner hanger 15*h* and release of the liner string 15 may be confirmed by raising and lowering of the LDA 5*d* using the deployment string.

Referring specifically to FIG. 3B, rotation 30 may resume and the cement slurry 109 may be pumped from the mixer 27 into the cementing swivel 6*c* via the valve 17*b* by the cement pump 16*c*. The cement slurry 109 may flow into the launcher 6*p* and be diverted past the dart 20 via the diverter and bypass passages. Once the desired quantity of cement slurry 109 has been pumped, the dart 20 may be released from the launcher 6*p* by the PLC 18 operating the actuator 6*h*. Displacement fluid 110 may be pumped into the cementing swivel 6*c* via the valve 17*b* by the cement pump 16*c*. The displacement fluid 110 may flow into the launcher 6*p* and be forced behind the dart 20 by closing of the bypass passages, thereby propelling the dart into the workstring bore. Pumping of the displacement fluid 110 by the cement pump 16*c* may continue until residual cement slurry in the cement discharge conduit has been purged. Pumping of the displacement fluid 110 may then be transferred to the mud pump 16*m* by closing the valve 17*b* and opening the Kelly valve 10. Alternatively, the cement pump 16*c* may be used to continue pumping of the displacement fluid 110 instead of switching to the mud pump 16*m*. The dart 20 may be driven through the workstring bore by pumping of the displacement fluid 110 until the dart (specifically seat 60*a*) lands onto the seat of wiper plug 19*a*, thereby closing a bore of the wiper plug. Continued pumping of the displacement fluid 110 may exert pressure on the combined dart and wiper plug 19*a*, 20 until the wiper plug 19*a* is released from the LDA plug release system.

Figures 3C, 3D:
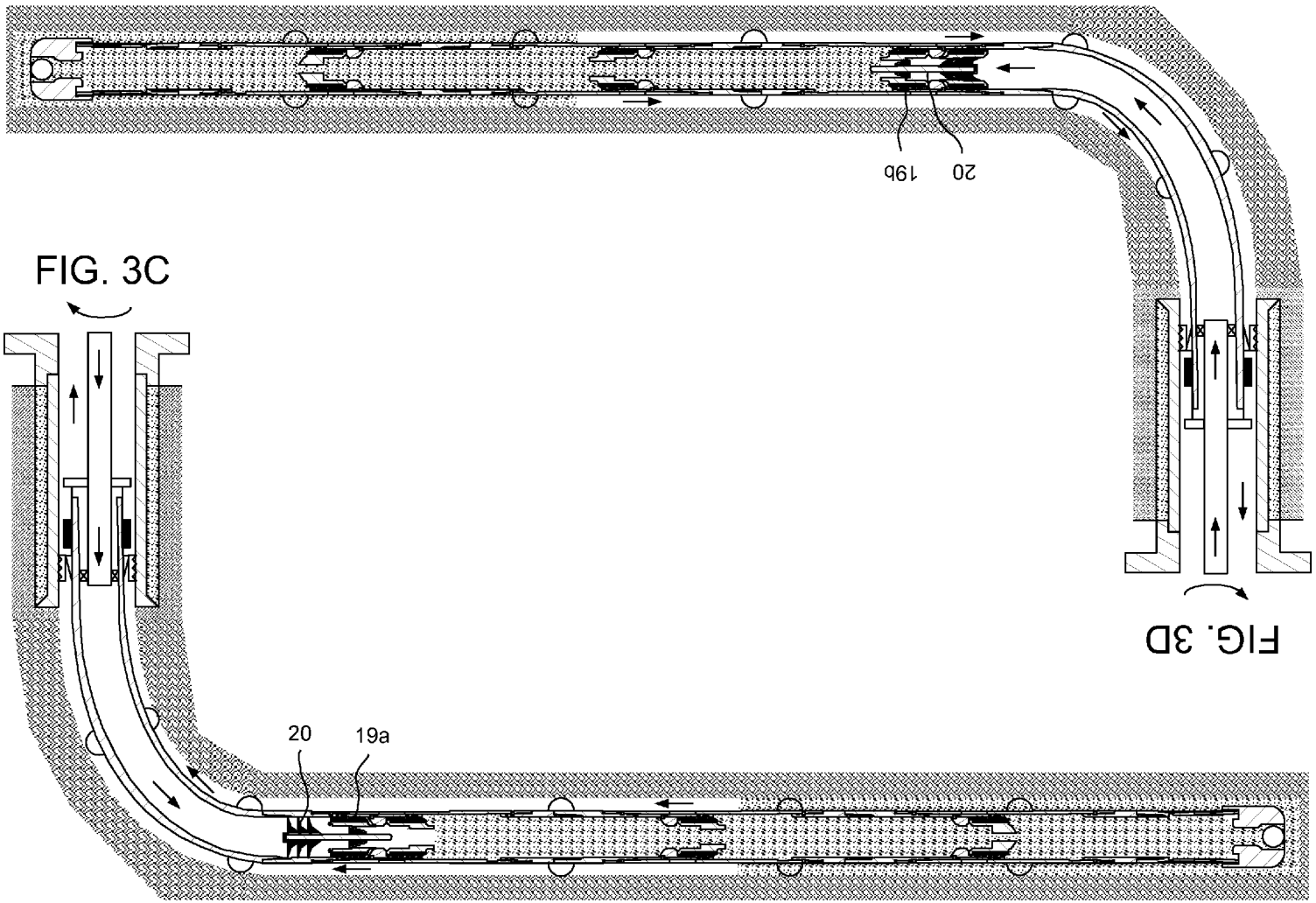

Referring specifically to FIG. 3C, once released, the combined dart and plug 19*a*, 20 may be driven through the liner bore by the displacement fluid 110, thereby driving cement slurry 109 through the float shoe 15*f* and into the annulus 8*a*. Pumping of the displacement fluid 110 may continue and the combined dart and plug 19*a*, 20 may land on the shoulder 53*u* in the first fracture valve 50*a*, thereby closing a bore of the collar 53. Continued pumping of the displacement fluid 110 may exert pressure on the combined dart and wiper plug 19*a*, 20 until the seat 60*a* is released from the dart 20 by fracturing the set 62*a* of shear screws.

Referring specifically to FIG. 3D, release of the seat 60*a* may free the rest of the dart 20 from the combined wiper plug and seat 19*a*, 60*a* and continued pumping of the displacement fluid 110 may force the fin stack 20*c,f* into the first wiper plug bore until the rest of the dart (specifically seat 60*b*) lands onto the seat of the wiper plug 19*b*. Continued pumping of the displacement fluid 110 may exert pressure on the combined dart and wiper plug 19*b*, 20 until the wiper plug 19*b* is released from the collar 53 by fracturing the set 57*w* of shear screws.

Figures 3E, 3F:
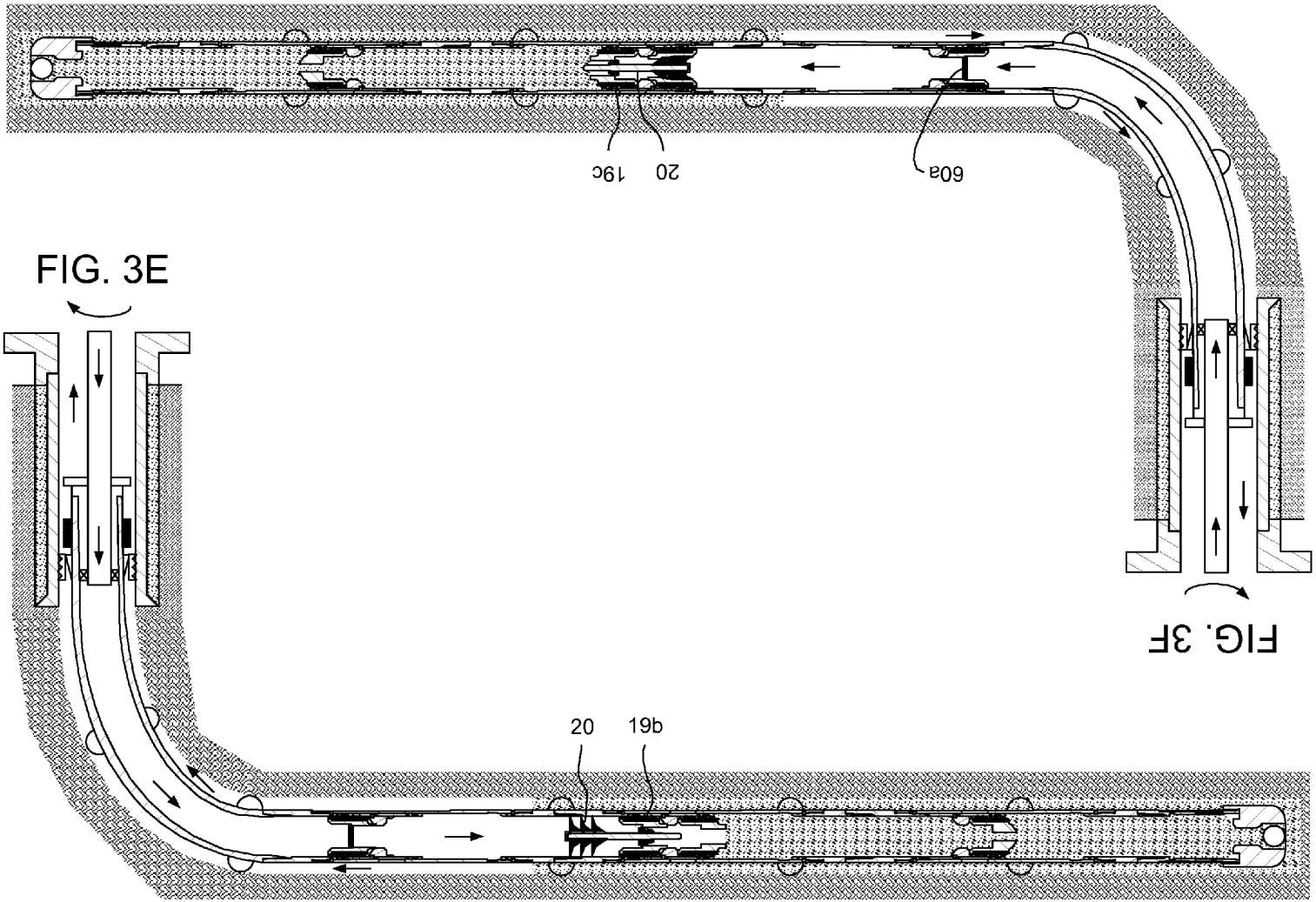

Referring specifically to FIG. 3E, once released, the fin stack 20*c,f* may be driven through the collar bore and the combined dart and plug 19*b*, 20 may be driven through the first fracture valve bore by continued pumping of the displacement fluid 110, thereby ensuring the first fracture valve bore is free from residual cement slurry that may otherwise cause malfunction of the first fracture valve 50*a*. Travel of the combined dart and plug 19*b*, 20 may also continue to drive cement slurry 109 through the float shoe 15*f* and into the annulus 8*a*. Pumping of the displacement fluid 110 may continue and the combined dart and plug 19*b*, 20 may land on the shoulder (see shoulder 53*u*) in the second fracture valve 50*b*, thereby closing a bore of the collar (see collar 53). Continued pumping of the displacement fluid 110 may exert pressure on the combined dart and wiper plug 19*b*, 20 until the seat 60*b* is released from the dart 20 by fracturing the set 62*b* of shear screws.

Referring specifically to FIG. 3F, release of the seat 60*b* may free the rest of the dart 20 from the combined wiper plug and seat 19*b*, 60*b* and continued pumping of the displacement fluid 110 may force the fin stack 20*c,f* into the second wiper plug bore until the rest of the dart (specifically seat 60*c*) lands onto the seat of the wiper plug 19*c*. Continued pumping of the displacement fluid 110 may exert pressure on the combined dart and wiper plug 19*c*, 20 until the wiper plug 19*c* is released from the collar (see collar 53) by fracturing the set (see set 57*w*) of shear screws.

Figures 3G, 3H:
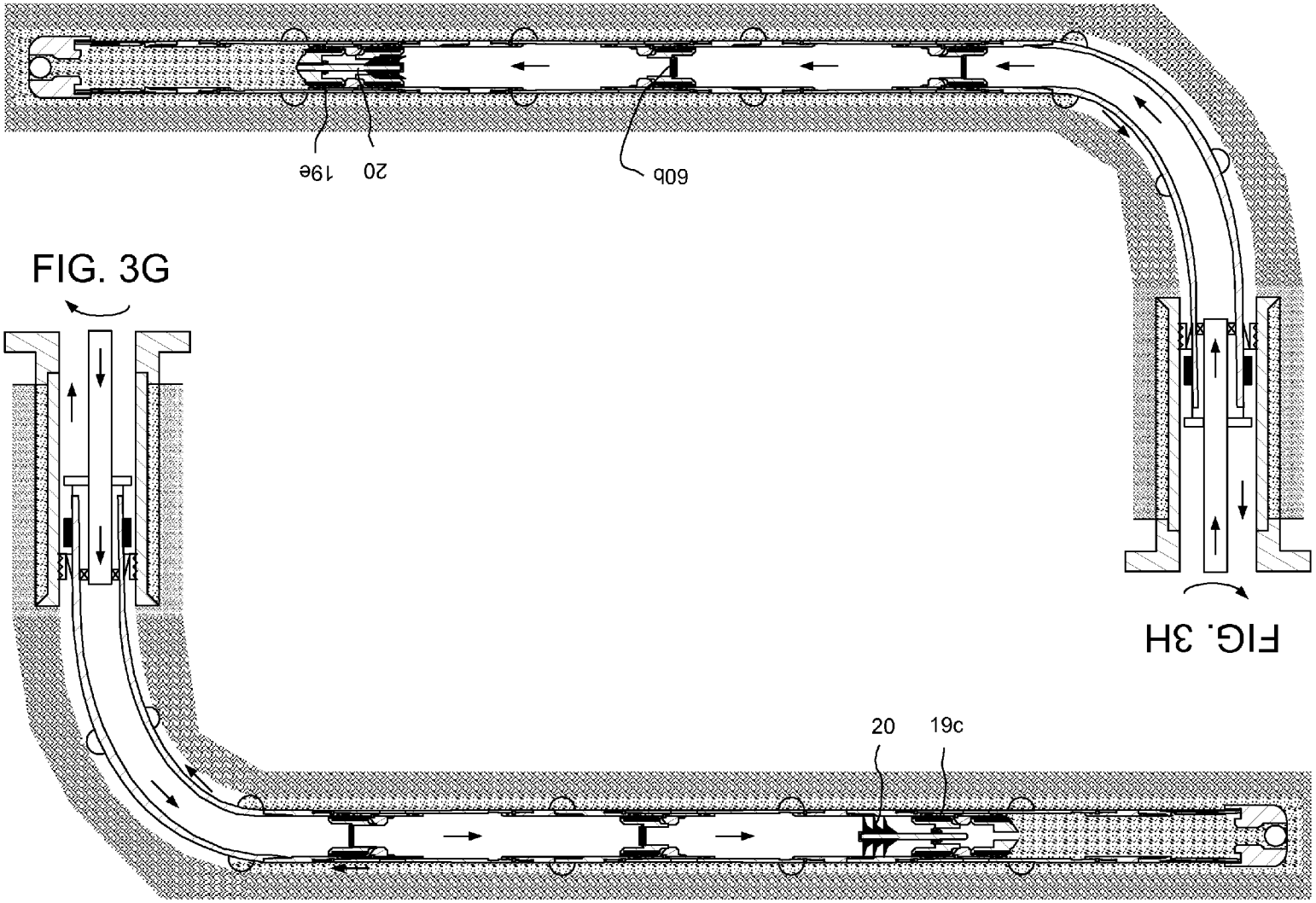

Referring specifically to FIG. 3G, once released, the fin stack 20*c,f* may be driven through the collar bore and the combined dart and plug 19*c*, 20 may be driven through the second fracture valve bore by continued pumping of the displacement fluid 110, thereby ensuring the second fracture valve bore is free from residual cement slurry that may otherwise cause malfunction of the second fracture valve 50*b*. Travel of the combined dart and plug 19*c*, 20 may also continue to drive cement slurry 109 through the float shoe 15*f* and into the annulus 8*a*. Pumping of the displacement fluid 110 may continue and the combined dart and plug 19*c*, 20 may land on the shoulder (see shoulder 53*u*) in the third fracture valve 50*c*, thereby closing a bore of the collar (see collar 53). Continued pumping of the displacement fluid 110 may exert pressure on the combined dart and wiper plug 19*c*, 20 until the seat 60*c* is released from the dart 20 by fracturing the set 62*c* of shear screws.

Referring specifically to FIG. 3H, release of the seat 60*c* may free the rest of the dart 20 from the combined wiper plug and seat 19*c*, 60*c* and continued pumping of the displacement fluid 110 may force the fin stack 20*c,f* into the third wiper plug bore until the rest of the dart (specifically retainer 60*r*) lands onto the seat of the wiper plug 19*e*. As discussed above, if a fourth fracture valve (not shown) is used, the dart 20 may instead land onto a shoulder of the wiper plug 19*d*. Continued pumping of the displacement fluid 110 may exert pressure on the combined dart and wiper plug 19*e*, 20 until the wiper plug 19*e* is released from the collar (see collar 53) by fracturing the set (see set 57*w*) of shear screws.

Figures 3I, 3J:
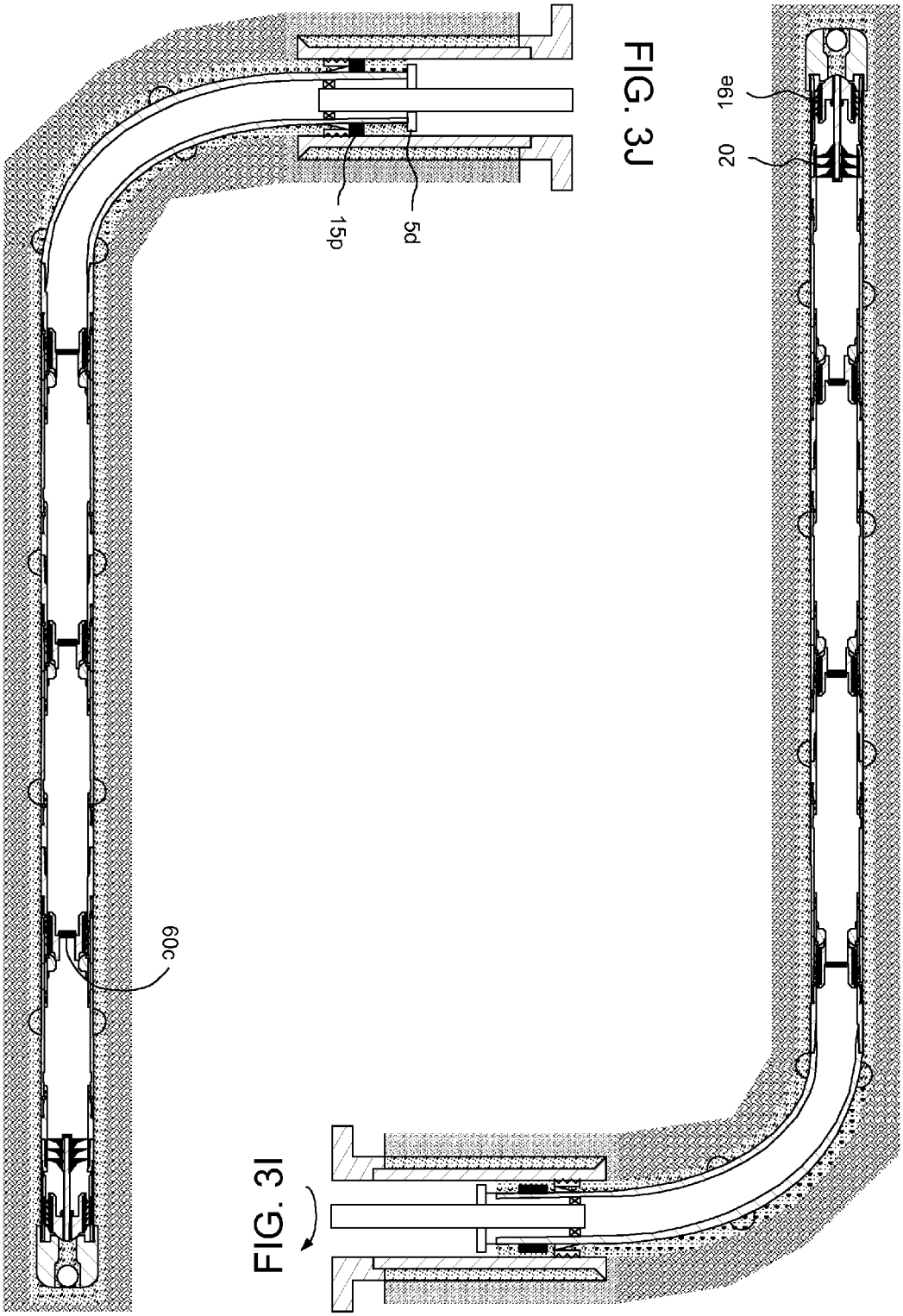

Referring specifically to FIG. 3I, once released, the fin stack 20*c,f* may be driven through the collar bore and the combined dart and plug 19*e*, 20 may be driven through the third fracture valve bore by continued pumping of the displacement fluid 110, thereby ensuring the third fracture valve bore is free from residual cement slurry that may otherwise cause malfunction of the third fracture valve 50*c*. Travel of the combined dart and plug 19*e*, 20 may also continue to drive cement slurry 109 through the float shoe 15*f* and into the annulus 8*a*. Pumping of the displacement fluid 110 may continue and the combined dart and plug 19*e*, 20 may land on a shoulder of the float shoe 15*f*, thereby increasing pressure in the liner 15 and workstring bore which may be detected by the PLC 18 monitoring the standpipe pressure.

Referring specifically to FIG. 3J, once landing has been detected, pumping of the displacement fluid 110 and rotation 30 of the liner 15 may be halted and the packer 15*p* set hydraulically or mechanically using the LDA setting tool. The LDA 5*d* may be raised from the liner hanger 15*h* and displacement fluid 110 circulated to wash away excess cement slurry (no excess shown). Pressure in the workstring 5 and liner bore may be bled. The float valve 15*f* may close, thereby preventing the cement slurry 109 from flowing back into the liner bore. The workstring 5 may then be retrieved to the rig 1*r* and the rig dispatched from the well site. Once the workstring 5 has been retrieved, the cement slurry 109 may be allowed to cure for a predetermined period of time.

Figure 4:
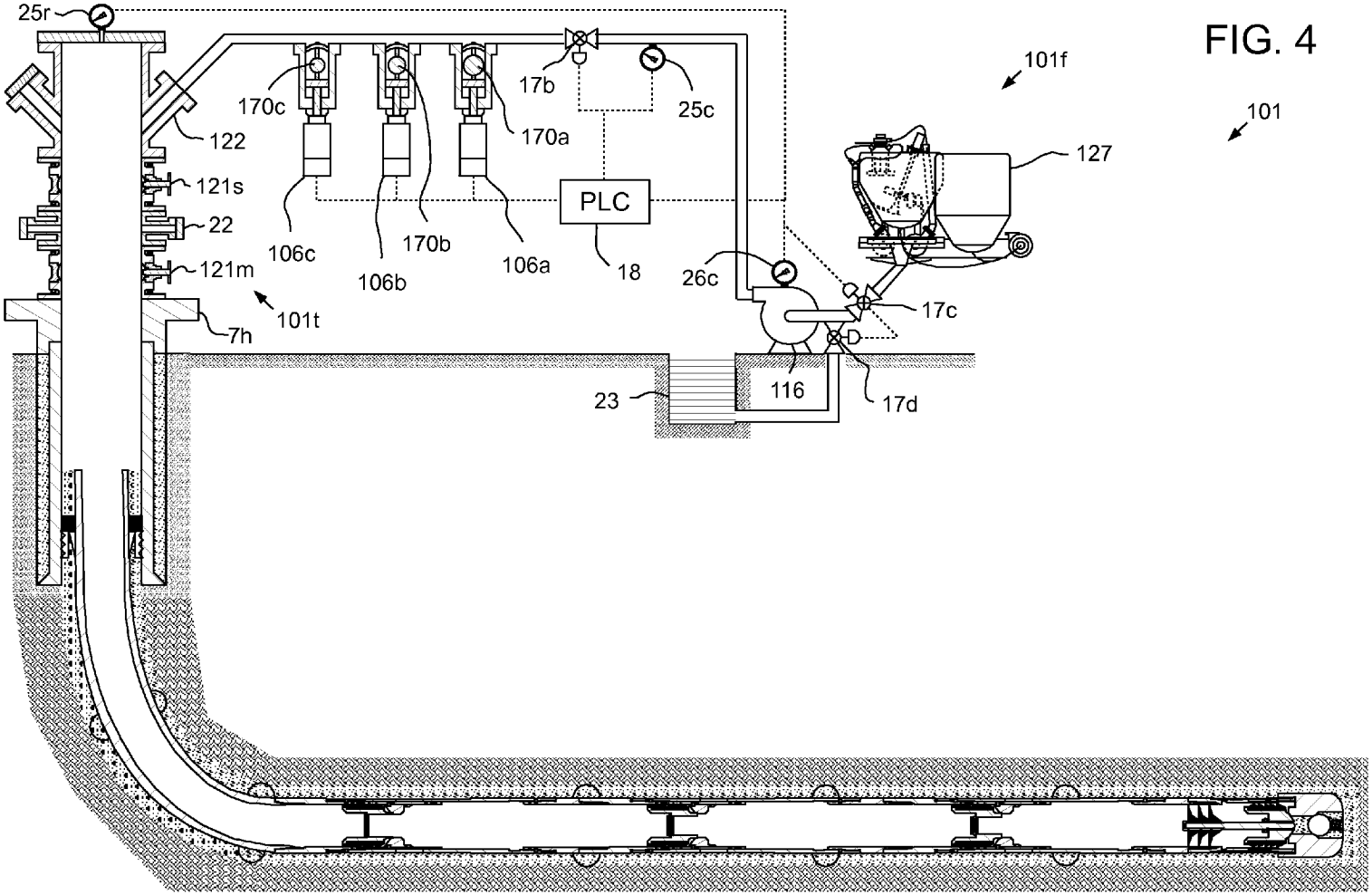
FIG. 4 illustrates a fracturing system.

FIG. 4 illustrates a fracturing system 101. The fracturing system 101 may be deployed once the rig 1*r* has been dispatched from the wellsite. The fracturing system 101 may include a fluid system 101*f* and a production tree 101*t*. The production tree 101*t* may be installed on the wellhead 7*h*. The production tree 101*t* may include a master valve 121*m*, the flow cross 22, and a swab valve 121*s*. Each component of the production tree 101*t* may be connected together, the production tree may be connected to the wellhead and an injector head 122, and the cap may be connected to the injector head, such as by flanges and studs or bolts and nuts. The fluid system if may include the one or more shutoff valves 17*b-d*, the PLC 18, the pit 23 (or other fluid reservoir, such as a tank), one or more sensors, such as the pressure sensors 25*c,r* and the stroke counter 26*c*, one or more launchers 106*a-c*, a fracture pump 116, the injector head 122, and a fracture fluid mixer, such as a recirculating mixer 127. Each sensor 25*c,r*, 26*c* may be in data communication with the PLC 18. The pressure sensor 25*r* may be connected to the head cap and may be operable to monitor wellhead pressure. The pressure sensor 25*c* may be connected between the fracture pump 116 and the valve 17*b* and may be operable to measure discharge pressure of the fracture pump 116. The stroke counter 26*c* may be operable to measure a flow rate of the fracture pump 116.

Each launcher 106*a-c* may include a housing, a plunger, and an actuator. The balls 170*a-c* may be disposed in the respective plungers for selective release and pumping downhole to activate respective fracture valves 50*a-c*. The plunger may be movable relative to the housing between a capture position and a release position. The plunger may be moved between the positions by the actuator. The actuator may be hydraulic, such as a piston and cylinder assembly. Alternatively, the actuator may be electric or pneumatic. Alternatively, the actuator may be manual, such as a handwheel. In operation, the PLC 18 may release one of the balls 170*a-c* by operating the HPU to supply hydraulic fluid to the respective actuator. The actuator may then move the plunger to the release position (not shown). The carrier and ball 170*a-c* may then move into a discharge pipe connecting the fracture pump 116 to the injector head 122. The pumped stream of fracturing fluid 111 (FIG. 5A) may then carry each ball 170*a-c* from the respective launcher 106*a-c* and into the wellhead 7*h* via the injector head 122 and tree 101*t*.

The first ball 170*a* may have a diameter greater than a diameter of each successive ball 170*b-c* and corresponding to a seat diameter of the top seat 60*a* such that the first ball may engage the top seat. The successive balls 170*b-c* may each have an outer diameter less than the seat diameter of the top seat 60*a* such that the rest of the balls 170*b-c* may pass through the top seat unobstructed. The second ball 170*b* may have a diameter greater than a diameter of the third ball 170*c* and corresponding to a seat diameter of the first intermediate seat 60*b* such that the second ball may engage the first intermediate seat. The third ball 170*c* may have a diameter less than the seat diameter of the first intermediate seat 60*b* such that the third ball 170*c* may pass through the first intermediate seat. The third ball 170*c* may have a diameter corresponding to a seat diameter of the second intermediate seat 60*c* such that the third ball may engage the second intermediate seat.

FIGS. 5A-5E illustrate a fracturing operation performed using the system 101. Referring specifically to FIG. 5A, the third ball 170*c* may be released from the launcher 106*c* by the PLC 18 operating the respective actuator and fracturing fluid 111 may be pumped from the mixer 127 into the injector head 122 via the valve 17*b* by the fracture pump 116. As discussed above, the fracturing fluid 111 may be a slurry including: proppant (i.e., sand), water, and chemical additives. Pumping of the fracturing fluid 111 may increase pressure in the liner bore until the differential is sufficient to open the toe sleeve 15*s*. Once the toe sleeve 15*s* has opened, continued pumping of the fracturing fluid 111 may force the displacement fluid 110 in the liner bore through the cured cement 109 and into the lower formation by creating a first fracture 130.

Referring specifically to FIG. 5B, continued pumping of the fracturing fluid 111 may drive the third ball 170*c* toward the third fracture valve 50*c* until a desired quantity for a third zone of the lower formation has been pumped. Once the desired quantity has been pumped, the second ball 170*b* may be released from the launcher 106*b* by the PLC 18 operating the respective actuator. Continued pumping of the fracturing fluid 111 may drive the balls 170*b,c* until the third ball lands onto the second intermediate seat 60*c*, thereby closing a bore of the third fracture valve 50*c*.

Figures 5C, 5D:
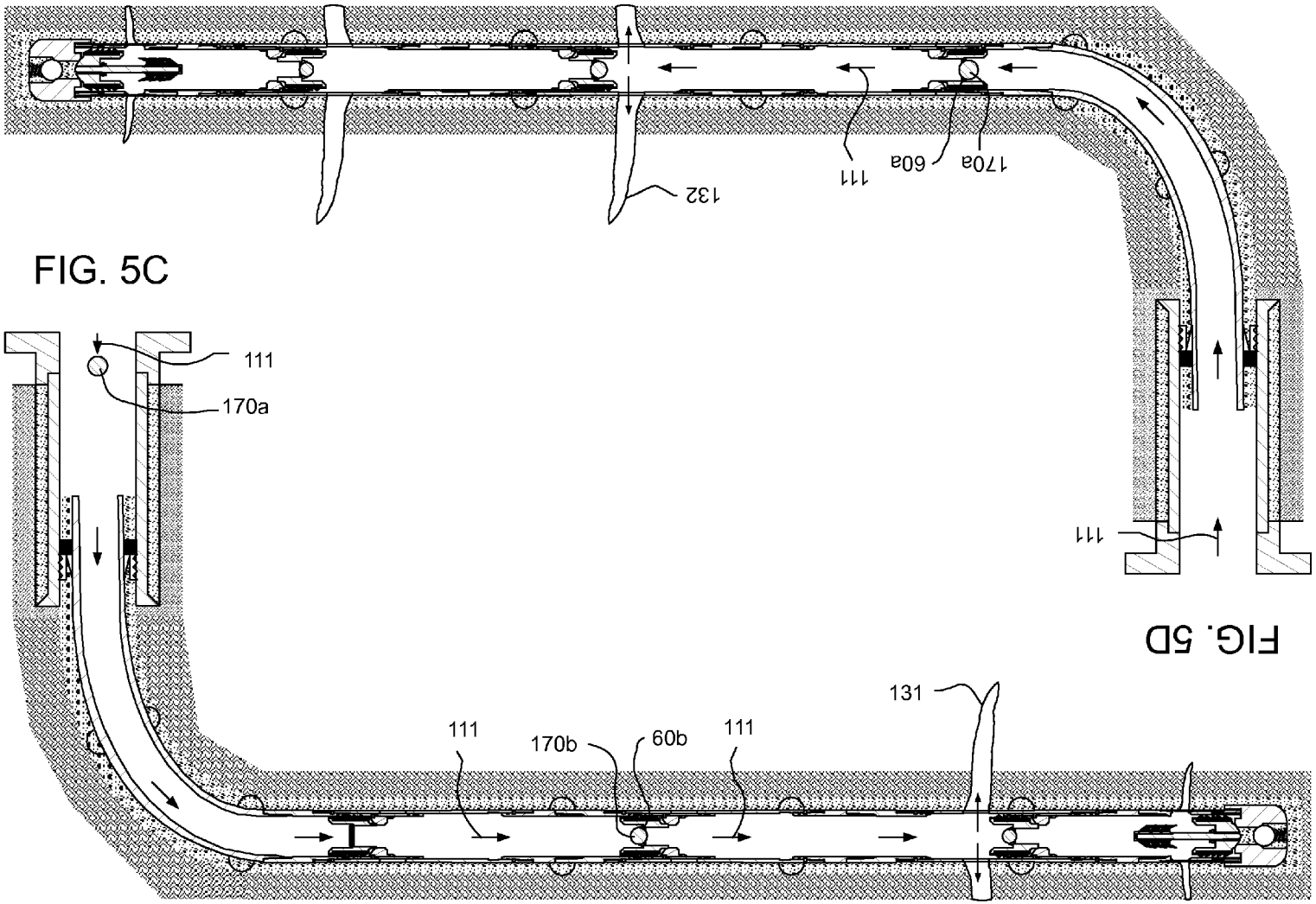
Figure 5E:
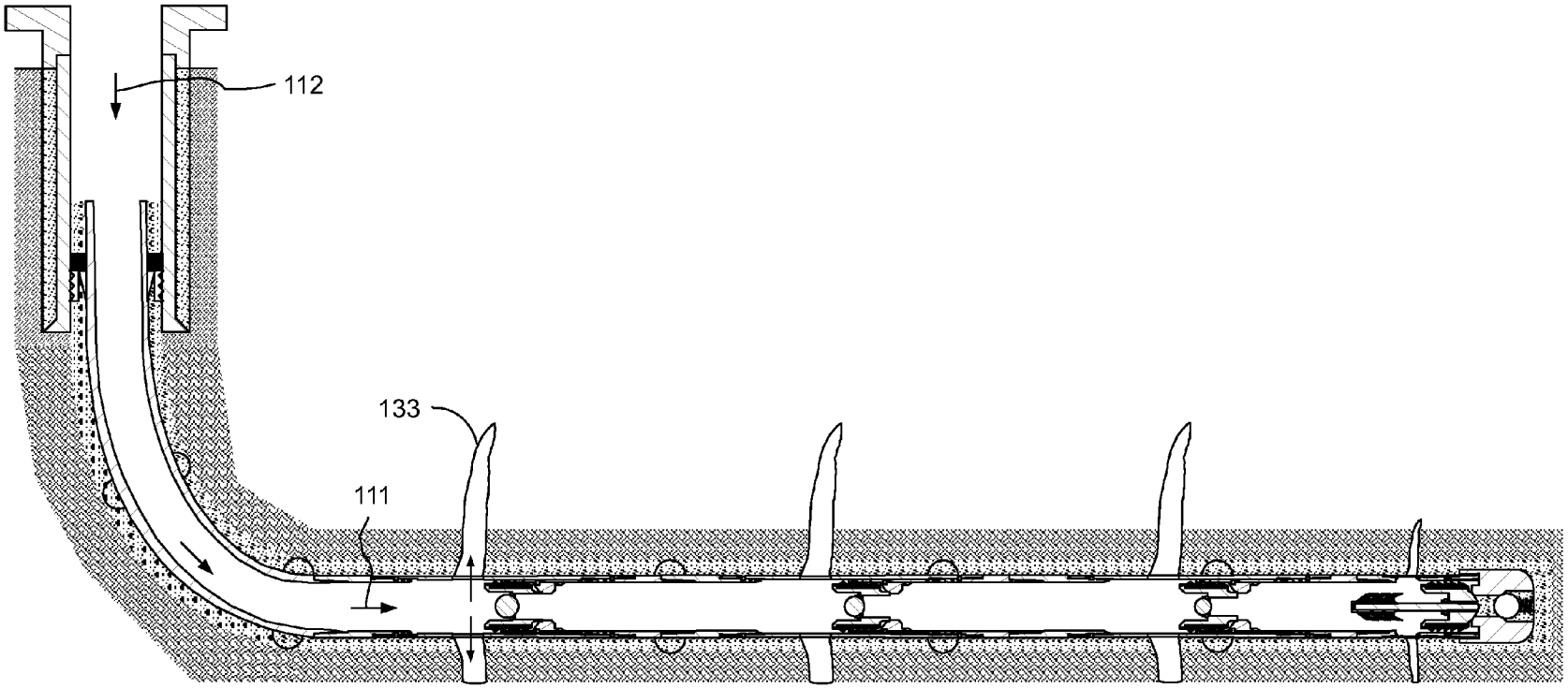

Referring specifically to FIG. 5C, continued pumping of the fracturing fluid 111 may exert pressure on the combined ball 170*c*, seat 60*c*, wiper plug 19*c*, collar (see collar 53), and sleeve (see sleeve 52) of the third fracture valve 50*c* until the sleeve is released from the housing (see housing 51*a*) by fracturing the shear ring (see shear ring 57*s*). Continued pumping of the fracturing fluid 111 may move the ball/seat/wiper plug/collar/sleeve combination longitudinally relative to the housing of the third fracture valve 50*c* until the sleeve is stopped by the lower shoulder (see lower shoulder 58*b*) and locked into place by the C-ring (see C-ring 61), thereby opening the fracture ports (see fracture ports 51*p*). Continued pumping of the fracturing fluid 111 may force the fracturing fluid (below the second ball 170*b*) through the cured cement 109 and into the third zone of the lower formation by creating a second fracture 131. As discussed above, proppant may be deposited into the second fracture 131 by the fracturing fluid 111. Continued pumping of the fracturing fluid 111 may also drive the second ball 170*b* toward the second fracture valve 50*b* until a desired quantity for a second zone of the lower formation has been pumped. Once the desired quantity has been pumped, the first ball 170*a* may be released from the launcher 106*a* by the PLC 18 operating the respective actuator. The fracturing fluid 111 may continue to be pumped into the third zone until the second ball 170*b* lands onto the first intermediate seat 60*b*, thereby closing a bore of the second fracture valve 50*b*.

Referring specifically to FIG. 5D, continued pumping of the fracturing fluid 111 may exert pressure on the combined ball 170*b*, seat 60*b*, wiper plug 19*b*, collar (see collar 53), and sleeve (see sleeve 52) of the second fracture valve 50*b* until the sleeve is released from the housing (see housing 51*a*) by fracturing the shear ring (see shear ring 57*s*). Continued pumping of the fracturing fluid 111 may move the ball/seat/wiper plug/collar/sleeve combination longitudinally relative to the housing of the second fracture valve 50*b* until the sleeve is stopped by the lower shoulder (see lower shoulder 58*b*) and locked into place by the C-ring (see C-ring 61), thereby opening the fracture ports (see fracture ports 51*p*). Continued pumping of the fracturing fluid 111 may force the fracturing fluid (below the first ball 170*a*) through the cured cement 109 and into the second zone of the lower formation by creating a third fracture 132. As discussed above, proppant may be deposited into the third fracture 132 by the fracturing fluid 111. Continued pumping of the fracturing fluid 111 may also drive the first ball 170*a* toward the first fracture valve 50*a* until a desired quantity for a first zone of the lower formation has been pumped. The fracturing fluid 111 may continue to be pumped into the second zone until the first ball 170*a* lands onto the top seat 60*a*, thereby closing a bore of the first fracture valve 50*a*.

Referring specifically to FIG. 5E, continued pumping of the fracturing fluid 111 may exert pressure on the combined ball 170*a*, seat 60*a*, wiper plug 19*a*, collar 53, and sleeve 52 of the first fracture valve 50*a* until the sleeve is released from the housing 51*a* by fracturing the shear ring 57*s*. Continued pumping of the fracturing fluid 111 may move the ball/seat/wiper plug/collar/sleeve combination longitudinally relative to the housing of the first fracture valve 50*a* until the sleeve is stopped by the lower shoulder 58*b* and locked into place by the C-ring 61, thereby opening the fracture ports 51*p*. Continued pumping of the fracturing fluid 111 may force the fracturing fluid through the cured cement 109 and into the first zone of the lower formation by creating a fourth fracture 133. As discussed above, proppant may be deposited into the fourth fracture 133 by the fracturing fluid 111. Pumping of the fracturing fluid 111 may continue until the desired quantity for the first zone has been pumped. Once the desired quantity has been pumped, displacement fluid 112 may be pumped to force the remaining fracturing fluid 111 into the first zone via the fourth fracture 133. The displacement fluid 112 may be water, drilling mud 107, conditioner 108, or the displacement fluid 110. Alternatively, fracturing fluid 111 may be used instead of the displacement fluid 112.

Alternatively, depending on parameters for a specific wellbore 8*w*, the balls 170*a-c* and desired quantities of fracturing fluid 111 may be pumped before the third ball 170*c* lands onto the second intermediate seat 60*c*. The displacement fluid 112 may then be pumped before and during opening of the fracture valves 50*a-c*.

Once the fracturing operation has been completed, the injector head 122 may be removed from the tree 101*t*. The flow cross 22 may be connected to the pit 23 and fluid allowed to flow from the wellbore to the pit. One or more of the balls 170*a-c* may or may not be recovered. A milling system (not shown) may then be deployed. The milling system may include a coiled tubing unit and a bottomhole assembly (BHA). The CTU may include an injector, a reel of coiled tubing, and a PCA. The BHA may include a drilling motor, such as a mud motor, and one or more mill bits. The BHA may be loaded into a tool housing of the PCA and connected to the coiled tubing. The PCA and injector may be connected to the tree 101*t*. The injector may be operated to lower the coiled tubing and BHA into the wellbore and the BHA operated to mill the millable portions of the fracture valves. The BHA and coiled tubing may then be retrieved and the milling system dispatched from the wellsite. A production choke may be connected to the flow cross and to a separation, treatment, and storage facility (not shown). Production of the lower formation may commence.

Figure 6A:
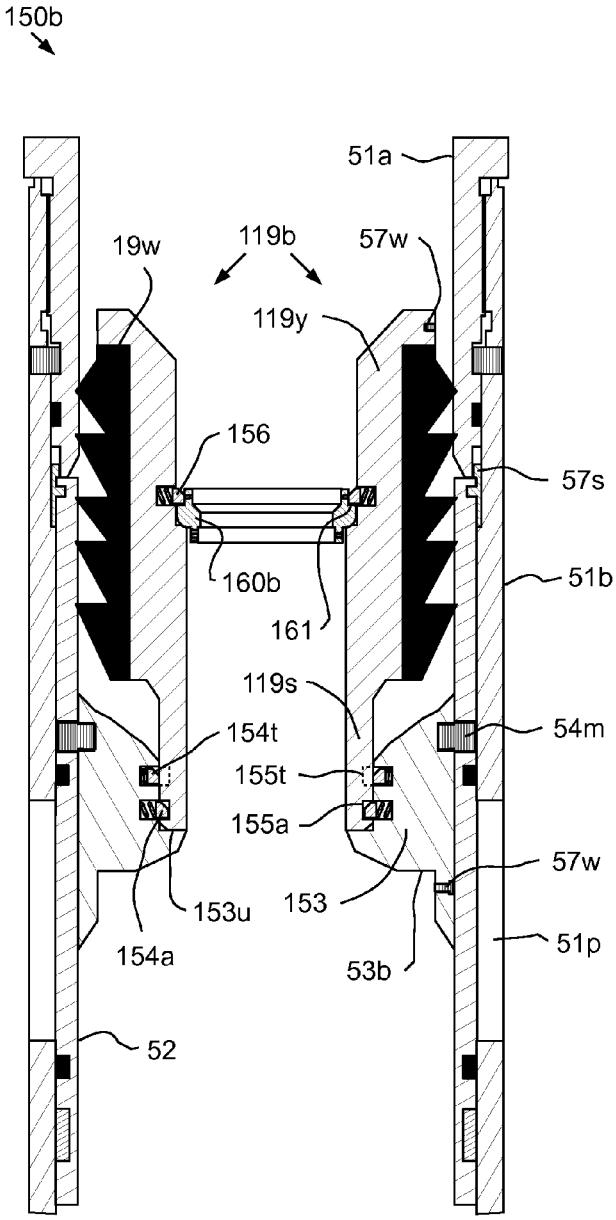
FIG. 6A illustrates a portion of an alternative fracture valve usable with the liner string, according to another embodiment of the present disclosure.

FIG. 6A illustrates a portion of an alternative second fracture valve 150*b* usable with the liner string 15, according to another embodiment of the present disclosure. The alternative fracture valve 150*b* may include the housing 51, the sleeve 52, a collar 153, an alternative wiper plug (not shown, similar to illustrated alternative wiper plug 119*b*), and one or more sets 154*a,t* of fasteners. The fracture valve 150*b* may be identical to the fracture valve 50*b* except for the substitution of the collar 153 for the collar 53 and substitution of the alternative wiper plug for the wiper plug 19*c*.

The collar 153 may be disposed in a bore of the sleeve 52 and connected longitudinally and torsionally thereto by the set screws 54*m*. The collar 153 may be made from any of the millable/drillable materials, discussed above. The collar 153 may be annular and have a bore formed therethrough. The collar 153 may have a landing shoulder 153*u* and the mounting shoulder 53*b*, each shoulder formed in an inner surface thereof. The mounting shoulder 53*b* may be mated with a top of the alternative wiper plug. The wiper plug 119*b* may have a body 119*y* and the wiper seal 19*w*. The body 119*y* may be annular and have a bore formed therethrough. The body 119*y* may have a seat formed in an inner surface thereof, a mounting shoulder formed in an outer surface thereof, and a stinger portion 119*s* forming a lower end thereof. The wiper plug 119*b* may be releasably connected to a collar (not shown) of an alternative first fracture valve (not shown, identical to the fracture valve 150*b* except for having the alternative wiper plug 119*b*) and seated against the respective mounting shoulder. The releasable connection may include the set 57*w* of shear screws.

A set 154*a* of one or more longitudinal fasteners, such as dogs, may be connected to the collar 153 and a set 154*t* of one or more torsional fasteners, such as dogs may be connected to the collar 153. Each dog may be radially movable between an extended position and a retracted position and may be biased toward the extended position by a spring. Each dog may have a cammed upper surface for being pushed inward to the retracted position by a cammed bottom of the stinger portion 154*s*. The stinger portion 119*s* may have a first complementary profile, such as a groove 155*a*, for receiving the longitudinal set 154*a* of fasteners and a second complementary profile, such as a set 155*t* of one or more slots, for receiving the torsional set 154*t* of fasteners. Since the torsional fasteners 154*t* may facilitate milling of the wiper plug 119*b*, the torsional fasteners need not be engaged with the set 155*t* of slots upon landing but may engage in response to contact of a mill bit (not shown) with the wiper plug 119*b*. A set 156 of one or more longitudinal fasteners, such as dogs, may be connected to the plug body 119*y* for receiving an alternative dart (only seat 160*b* shown). The set 156 may be similar to the collar set 154*a*. The seat 160*b* may be identical to the seat 60*b* except for the addition of a shoulder 161 for receiving the longitudinal set 156 of fasteners.

Alternatively, the collar 153 may have a set of threaded dogs (not shown) instead of the sets 154*a,t* of fasteners and the stinger portion 119*s* may have a threaded outer surface instead of the profiles 155*a,t*. Each dog may have a portion of a thread complementing the stinger portion thread. Each thread/thread portion may be a ratchet thread allowing longitudinal movement of the wiper plug 119*b* toward the collar landing shoulder 153*u* and preventing longitudinal movement of the wiper plug away from the collar landing shoulder. The ratchet thread/thread portions may also torsionally connect the collar 153 and the wiper plug 119*b*. Alternatively, a C-ring may be used instead of the set 154*a* and the set 156 of fasteners.

Alternatively, a C-ring may be used instead of the set 156 of threaded dogs to longitudinally connect the seat 160*b* to the plug body 119*y*. Alternatively, the plug body 119*y* may include an additional set of torsional fasteners and the seat 160*b* may have a mating torsional profile or the plug body may have the threaded dogs and the seat may have a complementary thread.

Additionally, the float shoe 15*f* may include any of the sets of longitudinal and/or torsional fasteners and the alternative dart may have complementary profile(s). Connection of the dart to the float shoe may obviate need for the check valve so that the check valve may be omitted from the float shoe.

Figure 6B:
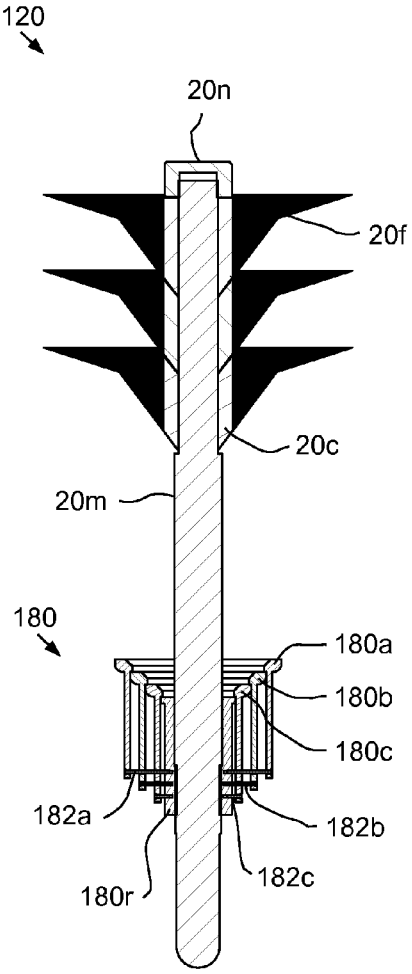
FIG. 6B illustrates an alternative dart usable with the liner string, according to another embodiment of the present disclosure.

FIG. 6B illustrates an alternative dart 120 usable with the liner string 15, according to another embodiment of the present disclosure. The dart 120 may include the mandrel 20*m*, the fin stack 20*c,f*, and a seat stack 180. The seat stack 180 may include one or more (three shown) seats 180*a-c* and a retainer 180*r*. Instead of the seats 180*a-c* being releasably connected to each other as for the dart 20, each seat 180*a-c* may be separately connected to the retainer 180*r* by a respective set 182*a-c* of one or more (two shown) shearable fasteners. A shear strength of each set 182*a-c* of shearable fasteners may be greater or substantially greater than a shear strength of each set 57*w* of shearable fasteners. A shear strength of the shear ring 57*s* may be greater or substantially greater than the shear strength of each set 182*a-c* of shearable fasteners and may be greater or substantially greater than the shear strength of each set 57*w* of shearable fasteners. A shear strength of each set 182*a-c* of shearable fasteners may be the same or different relative to one another.

Each seat 180*a-c* may have an outer seating surface for engagement with a seat of the respective wiper plug 19*a-c* and an inner seating surface for receiving the respective ball 170*a-c*. The top seat 180*a* may have an outer diameter greater than an outer diameter of each successive seat 180*b-c* (and the retainer 180*r*) and corresponding to the seat diameter 65*a* such that the top seat may engage the seat of the wiper plug 19*a*. The successive seats 180*b-c* (and the retainer 180*r*) may each have an outer diameter less than the seat diameter 65*a* such that the rest of the seats 180*b-c* may pass through the wiper plug seat unobstructed. The intermediate seat 180*b* may have an outer diameter greater than an outer diameter of a bottom seat 180*c* (and the retainer 180*r*) and corresponding to the seat diameter 65*b* such that the intermediate seat may engage the seat of the wiper plug 19*b*. The bottom seat 180*c* (and the retainer 60*r*) may each have an outer diameter less than the seat diameter 65*b* such that the rest of the bottom seats 180*c* may pass through the wiper plug seat unobstructed. The bottom seat 180*c* may have an outer diameter greater than an outer diameter of the retainer 180*r* and corresponding to the seat diameter 65*c* such that the bottom seat may engage the seat of the wiper plug 19*c*. The retainer 180*r* may have an outer diameter less than the seat diameter 65*c* such that the retainer 180*r* may pass through the wiper plug seat unobstructed. The retainer 180*r* may have an outer seating surface and a threaded inner surface and the outer surface of the mandrel 20*m* may have a lower shouldered thread for receiving the retainer 20*r*.

FIGS. 7A-7E illustrate a cluster fracture valve 250 and dart 220 (and operation thereof) usable with the liner string 15, according to another embodiment of the present disclosure. The cluster valve 250 may include the housing 51, the sleeve 52, the collar 53, and a wiper plug 219*c*, and one or more (two shown) buttons 251. A cluster of one or more (two at least partially shown) of the cluster valves 250 and the fracture valve 50*c* may be assembled with the liner string 15 instead of the valves 50*a-c*. The fracture valve 50*c* may be located at the bottom of the cluster. Each valve 250 in the cluster may be identical except that the cluster valve (not shown) adjacent the fracture valve 50*c* may have a slightly modified cluster wiper plug (not shown). An additional cluster wiper plug (not shown) may be slightly modified for connection to the LDA plug release system, as discussed above for the wiper plug 19*a*. Alternatively, each cluster valve 250 and/or the dart 220 may be modified to include any of the sets of longitudinal and/or torsional fasteners, discussed above for the fracture valve 150*b*.

Each button 251 may be disposed in a respective port 51*p* and connected to the housing 51, such as by a threaded connection. A series of small orifices may be formed through each button 251 and may allow leakage through the ports 51*p* when the sleeve 52 is in the open position. Each button 251 may be made from an erosion-prone material, such as aluminum, polymer, or brass. The orifices may be arranged in a peripheral cross-pattern around the button's center and joined slots may be formed in the inner surface of each button and may extend through the peripheral orifices and the center of each button 251. A hex-shaped orifice may be formed at the center of each button 251 for screwing each button 251 into the respective housing port 51*p*. Once the sleeve 52 has moved to the open position (FIG. 7D), the leakage through the button orifices may be small enough to not compromise differential pressure between the housing bore and the annulus 8*a* until the bottom valve of the cluster has been opened. As fracturing fluid 111 leaks through the orifices, rapid erosion may be encouraged by the pattern of the orifices and the slots.

The fracture valve 50*c* may or may not have the buttons 251. Alternatively, the buttons 251 may be omitted in favor of relying on the cured cement 109 to limit flow of fracturing fluid through the open ports 51*p* until the bottom valve of the cluster has been opened. Alternatively rupture disks may be used instead of the buttons 251.

Each of the wiper plugs 219*b,c* may include a body 219*y*, the wiper seal 19*w*, a seat 265*a,b*, and one or more sleeves, such as an inner sleeve 218*i* and an outer sleeve 218*o*. The body 219*y* may be annular and have a bore formed therethrough. The body 219*y* may have a mounting shoulder formed in an outer surface thereof and a stinger portion 219*s* forming a lower end thereof. The wiper plug 219*c* may be releasably connected to the collar 53 and the wiper plug 219*b* may be releasably connected to a collar (not shown) of another identical cluster valve (not shown) and seated against the respective mounting shoulder. Each releasable connection may include the set 57*w* of shear screws. The body 219*y*, sleeves 218*i,o*, and seat 265*a,b* may each be made of one of the millable/drillable materials, discussed above. The seat 265*a,b* may include a plurality of dogs, such as a first dog 265*a* and a second dog 265*b*. Each dog 265*a,b* may have a stem portion and a tab portion and may be movable between an extended position (FIG. 7A), a first retracted position (FIG. 7B) and a second retracted position (FIG. 7E). Each dog 265*a,b* may be received by a respective opening formed through a wall of the inner sleeve 218*i*. Each opening may include a through portion for receiving a respective dog stem portion and a recess portion for engaging the respective tab portion.

The outer sleeve 219*o* may have slots 217*i* formed through a wall thereof for receiving an outer portion of the respective dog 265*a,b*. The body 219*y*, such as at the stinger portion 219*s*, may have slots 217*o* formed in an inner surface thereof also for receiving an outer portion of the respective dog 265*a,b*. Each sleeve may 218*i,o* may be longitudinally movable relative to the body subject to interaction with the seat 265*a,b*, an upper shoulder formed in an inner surface of the body, and a lower shoulder formed by a fastener, such as C-ring. The inner sleeve-outer sleeve interface and the outer sleeve-body interface may each be sealed, such as by respective seals carried by the sleeves. The seals may each be single element or seal stacks, as discussed above. The outer sleeve 219*o* may be releasably connected to the body 219*y* in an upper position by a set 257*o* of one or more shearable fasteners, such as shear screws. The inner sleeve 219*i* may be releasably connected to the outer sleeve 219*o* in an upper position by a set 257*i* of one or more shearable fasteners, such as shear screws. To maintain alignment of the dogs 265*a,b* and slots 217*i,o*, the sleeves 218*i,o* may be torsionally connected and the outer sleeve and the body 219*y* may be torsionally connected, such as by pin-slot connections (not shown).

A shear strength of each outer set 257*o* of shearable fasteners may be greater or substantially greater than a shear strength of the shear ring 57*s*, may be greater or substantially greater than the shear strength of each inner set 257*i* of shearable fasteners, and may be greater or substantially greater than the shear strength of each set 57*w* of shearable fasteners. A shear strength of the shear ring 57*s* may be greater or substantially greater than the shear strength of each inner set 257*i* of shearable fasteners and may be greater or substantially greater than the shear strength of each set 57*w* of shearable fasteners. A shear strength of each inner set 257*i* of shearable fasteners and may be greater or substantially greater than the shear strength of each set 57*w* of shearable fasteners.

The dart 220 may include the mandrel 20*m*, the fin stack 20*c,f*, and an actuator, such as a bung 260. The bung 260 may have an outer seating surface and a threaded inner surface for connection to the mandrel 20*m*.

In operation, the dart 220 may be driven through the workstring bore by pumping of the displacement fluid 110 until the dart (specifically seat bung 260) lands onto the seat of the LDA (first) cluster wiper plug, thereby closing a bore of the first cluster plug. Continued pumping of the displacement fluid 110 may exert pressure on the combined dart and wiper plug 220 until the first wiper plug is released from the LDA plug release system. Once released, the combined dart and plug 220 may be driven through the liner bore by the displacement fluid 110, thereby driving cement slurry 109 through the float shoe 15*f* and into the annulus 8*a*. Pumping of the displacement fluid 110 may continue and the combined dart and plug 220 may land on the shoulder (see 53*u*) in the first cluster valve (see 250), thereby closing a bore of the collar 53.

Continued pumping of the displacement fluid 110 may exert pressure on the combined dart and wiper plug 220 until the dart 220 is released from the LDA wiper plug by operation of the seat (see 265*a,b*) to the first retracted position. Continued pumping of the displacement fluid 110 may force the fin stack 20*c,f* into the first wiper plug bore until the dart 220 (specifically bung 260) lands onto the seat 265*a,b* of the second cluster wiper plug 219*b*. Continued pumping of the displacement fluid 110 may exert pressure on the combined dart and wiper plug 219*b*, 220 until the wiper plug 219*b* is released from the collar (see collar 53) by fracturing the set 57*w* of shear screws. Once released, the fin stack 20*c,f* may be driven through the collar bore and the combined dart and plug 219*b*, 220 may be driven through the first fracture valve bore by continued pumping of the displacement fluid 110, thereby ensuring the first fracture valve bore is free from residual cement slurry that may otherwise cause malfunction of the first fracture valve.

Figure 7A:
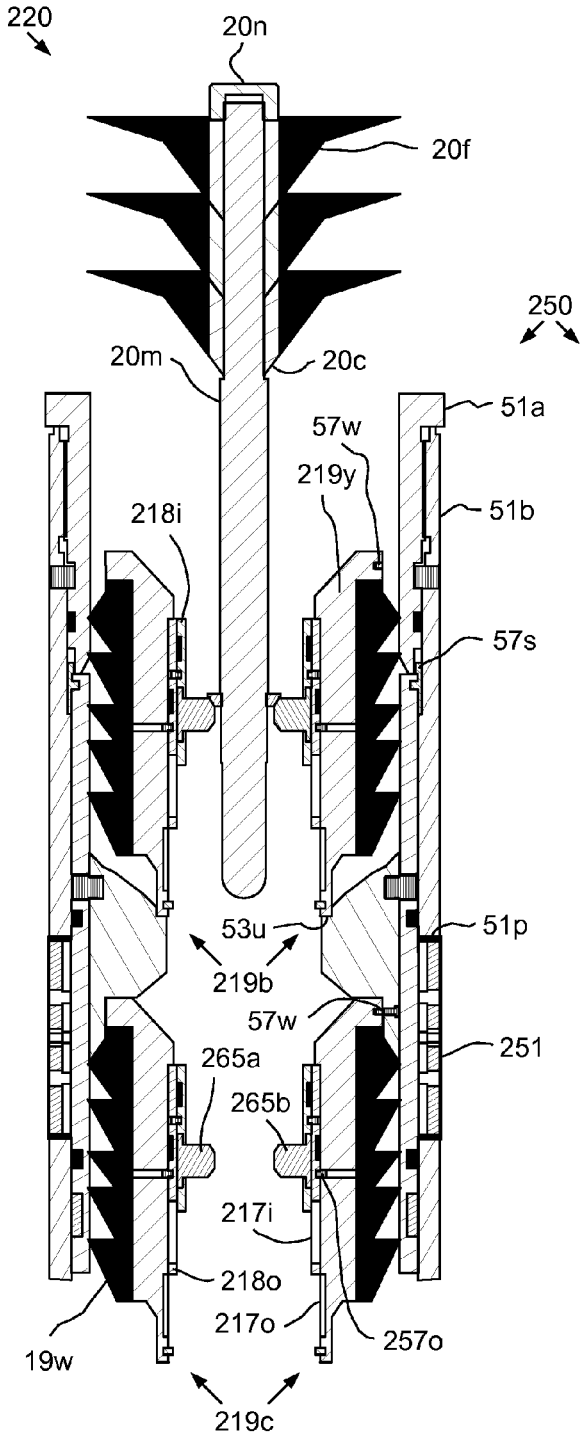
FIGS. 7A-7E illustrate a cluster fracture valve and dart (and operation thereof) usable with the liner string, according to another embodiment of the present disclosure.

Referring specifically to FIG. 7A, travel of the combined dart and plug 219*b*, 220 may also continue to drive cement slurry 109 through the float shoe 15*f* and into the annulus 8*a*. Pumping of the displacement fluid 110 may continue and the combined dart and plug 219*b*, 220 may land on the shoulder 53*u* in the second fracture valve 250, thereby closing a bore of the collar 53.

Figure 7B:
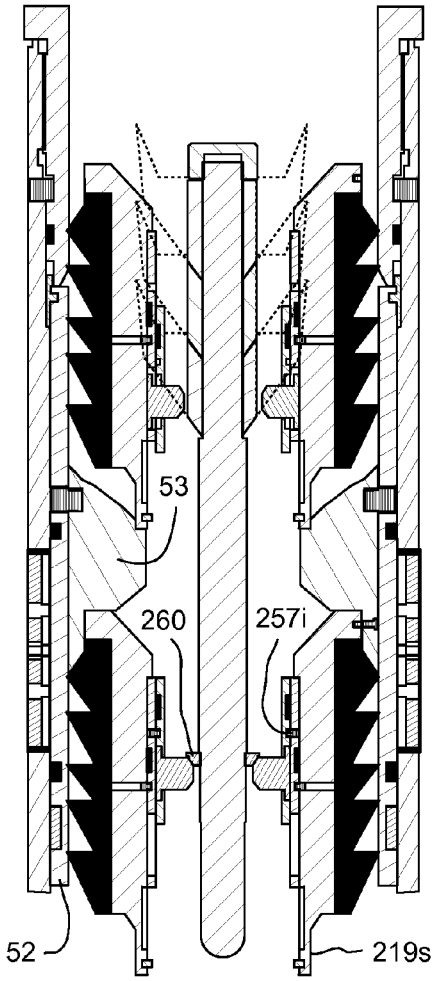

Referring specifically to FIG. 7B, continued pumping of the displacement fluid 110 may exert pressure on the combined dart and wiper plug 219*b*, 220 until the inner sleeve 218*i* is released from the outer sleeve 218*o* by fracturing the inner set 257*i* of shear screws. Continued pumping of displacement fluid 110 may drive the combined dart and inner sleeve 218*i*, 220 downward relative to the second plug body 219*y* until the seat 265*a,b* aligns with the inner slot 217*i*. The bung 260 may then push the seat 265*a,b* into the inner slot 217*i*, thereby moving the seat to the first retracted position and releasing the dart 220 from the second wiper plug 219*b*. Continued pumping of the displacement fluid 110 may force the fin stack 20*c,f* into the second wiper plug bore until the dart 220 (specifically bung 260) lands onto the seat 265*a,b* of the third wiper plug 219*c*.

Continued pumping of the displacement fluid 110 may exert pressure on the combined dart and wiper plug 219*c*, 220 until the wiper plug 219*c* is released from the collar 53 by fracturing the set 57*w* of shear screws. Once released, the fin stack 20*c,f* may be driven through the collar bore and the combined dart and plug 219*c*, 220 may be driven through the second cluster valve bore by continued pumping of the displacement fluid 110, thereby ensuring the second cluster valve bore is free from residual cement slurry that may otherwise cause malfunction of the second cluster valve. The cementing operation may continue until the dart 220 has traveled through the rest of the cluster valves 250 and lands onto the fracture valve 50*c* and releases the wiper plug 19*e* therefrom and the combined dart and wiper plug 19*e*, 220 land in the float shoe 15*f*.

Figure 7C:
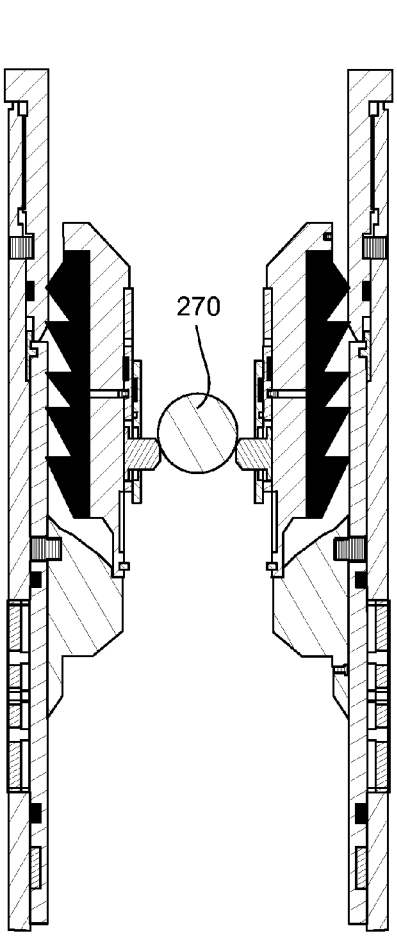

Referring specifically to FIG. 7C, once the cement slurry 109 has cured, the ball 270 may be released from one of the launchers 106*a-c* by the PLC 18 operating the respective actuator and fracturing fluid 111 may be pumped from the mixer 127 into the injector head 122 via the valve 17*b* by the fracture pump 116. Pumping of the fracturing fluid 111 may increase pressure in the liner bore until the differential is sufficient to open the toe sleeve 15*s*. Once the toe sleeve 15*s* has opened, continued pumping of the fracturing fluid 111 may force the displacement fluid 110 in the liner bore through the cured cement 109 and into the lower formation by creating the first fracture 130. Continued pumping of the fracturing fluid 111 may drive the ball 270 until the ball lands onto the seat of the first wiper plug, thereby closing a bore of the first fracture valve. Continued pumping of the fracturing fluid 111 may exert pressure on the combined ball/seat/wiper plug/collar/sleeve until first fracture valve opens and the ball 270 is released by moving the seat to the second retracted position. Even though the sleeve has moved to the open position, the ports may still be choked by the buttons 251. Continued pumping of the fracturing fluid 111 may drive the ball 270 until the ball lands onto the seat of the second wiper plug 219*b*, thereby closing a bore of the second fracture valve 50*b*.

Figure 7D:
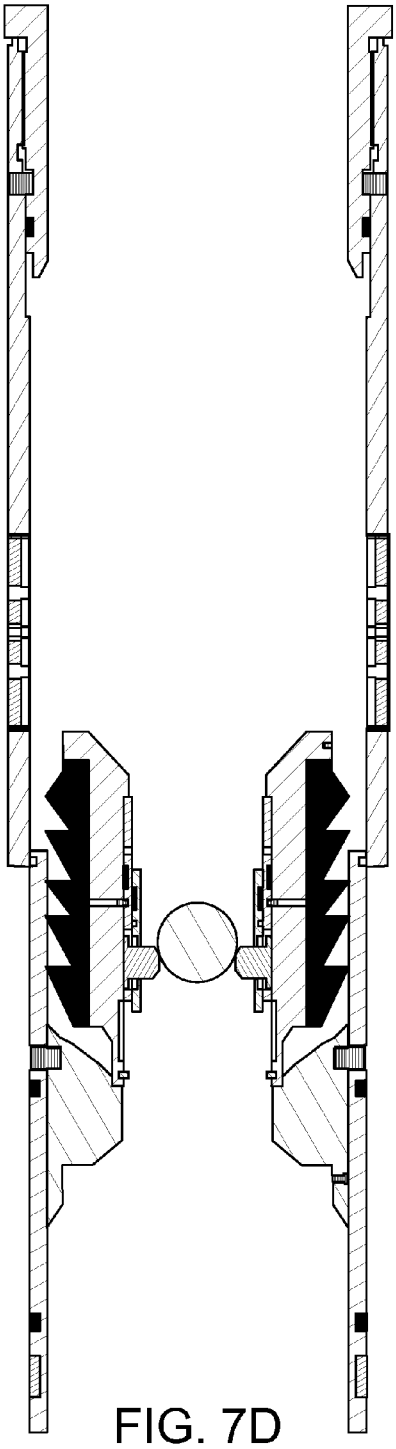
Figure 7E:
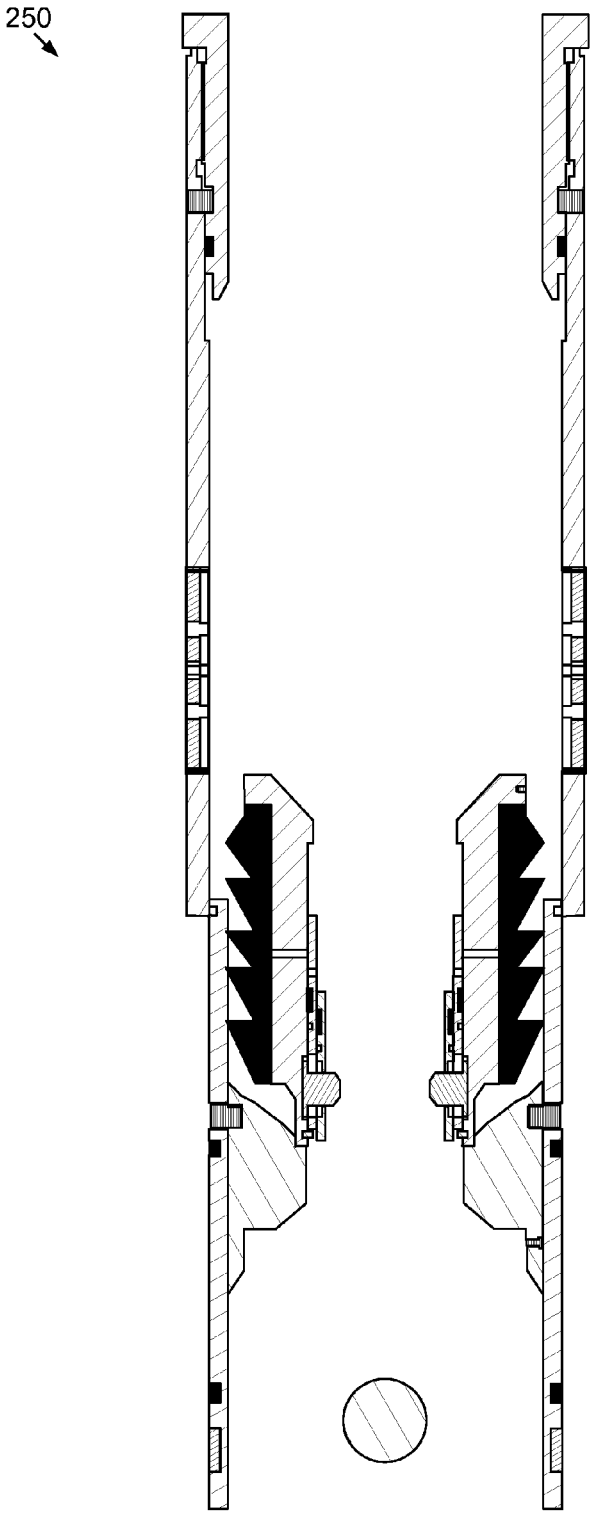

Referring specifically to FIG. 7D, continued pumping of the fracturing fluid 111 may exert pressure on the combined ball 270, seat 265*a,b*, wiper plug 219*b*, collar 53, and sleeve 52 of the second fracture valve 250 until the sleeve is released from the housing 51*a* by fracturing the shear ring 57*s*. Continued pumping of the fracturing fluid 111 may move the ball/seat/wiper plug/collar/sleeve combination longitudinally relative to the housing of the second fracture valve 50*b* until the sleeve is stopped by the lower shoulder (see lower shoulder 58*b*) and locked into place by the C-ring 61, thereby opening (choked by buttons 251) the fracture ports 51*p*.

Referring specifically to FIG. 7E, continued pumping of the fracturing fluid 111 may exert pressure on the combined dart and wiper plug 219*b*, 220 until the outer sleeve 218*o* is released from the plug body 219*y* by fracturing the outer set 257*o* of shear screws. Continued pumping of the fracturing fluid 111 may drive the combined dart and inner sleeves 218*i,o*, 220 downward relative to the second plug body 219*y* until the seat 265*a,b* aligns with the outer slot 217*o*. The ball 270 may then push the seat 265*a,b* into the outer slot 217*o*, thereby moving the seat to the second retracted position and releasing the ball 270 from the second wiper plug 219*b*. The fracturing operation may continue until all the ball 270 has traveled through to the fracture valve 50*c* (having the modified cluster wiper plug seated therein) and lands onto the seat of the modified cluster wiper plug. The modified cluster wiper plug may be similar to the other wiper plugs 219*b,c* except for not having a second retracted position, thereby catching but not releasing the ball 270. Once the ball 270 is caught, continued pumping of the fracturing fluid 111 may quickly erode the buttons 251 so that the fracturing fluid may flow freely through the fracturing ports and create the fractures 131-133.

Additionally, a second (or more) cluster (not shown) having one or more cluster valves may be added to the liner string 15. The second cluster may include one or more cluster valves and the fracture valve having the wiper plug 19*d* located at the bottom of the second cluster, each cluster valve identical to the cluster valve 250 except for having different cluster wiper plugs. The second cluster wiper plugs may each be similar to the wiper plugs 219*b,c* except for having a larger seat size. The dart 20 (having only the seat 60*d* and retainer 60*r*) may be used with the dual cluster system. The two (or more) clusters may be arranged in series with the second (larger seat size) cluster located above the first (smaller seat size) cluster. The dart 20 may be launched after the cement slurry is pumped and may be propelled by the displacement fluid 110 to the LDA cluster plug. The dart may travel through the workstring and launch the LDA cluster plug (second cluster seat size). The combined dart and LDA wiper plug 20 may land in the second cluster valve and launch the second cluster wiper plug as discussed above. The combined dart and second cluster wiper plug 20 may land in the fracture valve (having the wiper plug 19*d*) and launch the wiper plug 19*d*. The combined dart and wiper plug 19*d* may land in a top of the first cluster valves 250. The dart 20 may release the seat 60*d* in the wiper plug 19*d* and launch the top first cluster wiper plug 219*b* using the retainer 60*r*. The dart 20 and top first cluster wiper plug 19*b* may then land in the next first cluster valve 250 and launch the next first cluster wiper plug 219*c*. The cementing process may conclude as discussed above. For the fracturing operation, the ball 270 may be launched to operate the first cluster valves (minus the top first cluster valve) and then a second larger ball (not shown) may be launched to operate the second cluster valves (plus the top first cluster valve).

Alternatively, each seat 265*a,b* may have a C-ring instead of the dogs 265*a,b*. Alternatively, the wiper plugs 219*b,c* may each have a resettable seat, such as a collet and spring, instead of the seat 265*a,b* and sleeves 218*i,o*. Alternatively, the dart 220 may have a retractable actuator, such as a C-ring, and the ball 270 may be deformable instead of the wiper plugs 219*b,c* having the retractable seats 265*a,b*.

Alternatively, any of the fracture valves, wiper plugs, and/or darts may be used in other types of stimulation operations besides fracturing. Alternatively, any of the fracture valves, wiper plugs, and/or darts may be used in a staged cementing operation of a casing or liner string instead of a cementing and fracturing operation.

While the foregoing is directed to embodiments of the present disclosure, other and further embodiments of the disclosure may be devised without departing from the basic scope thereof, and the scope of the invention is determined by the claims that follow.

The invention claimed is:

1. A method of cementing a liner string into a wellbore, comprising:

deploying a liner string into the wellbore to a portion of the wellbore traversing a productive formation using a workstring, the liner string comprising a first fracture valve and the workstring comprising a first wiper plug;

pumping cement slurry into the workstring; and pumping a dart through the workstring, thereby driving the cement slurry into the liner string, wherein:

the dart engages the first wiper plug and releases the first wiper plug from the workstring, the dart and engaged first wiper plug drive the cement slurry through the liner string and into an annulus formed between the liner string and the wellbore, the dart and engaged first wiper plug land onto the first fracture valve, the dart releases a first seat into the first wiper plug, and the dart engages a second wiper plug connected to the first fracture valve and releases the second wiper plug from the first fracture valve.

2. The method of claim 1, wherein:

the liner string further comprises a second fracture valve;

the dart and engaged second wiper plug further drive the cement slurry through the liner string and into an annulus formed between the liner string and the wellbore, the dart and engaged second wiper plug land onto the second fracture valve, the dart releases a second seat into the second wiper plug, and the dart engages a third wiper plug of the second fracture valve and releases the third wiper plug from the second fracture valve.

3. The method of claim 2, further comprising:

after curing of the cement slurry, deploying first and second balls through the liner string to the first and second seats, wherein the first and second balls land onto the respective first and second seats and open the respective first and second fracture valves.

4. The method of claim 3, wherein:

the first and second balls are deployed to the first and second seats by pumping fracturing fluid, and pumping of the fracturing fluid is continued, thereby forcing the fracturing fluid through the respective open fracture valves and the cured cement and into the productive formation by creating respective first and second fractures.

5. The method of claim 4, wherein:

the second ball is pumped ahead of the first ball, and the first ball has a diameter greater than a diameter of the second ball, the second ball travels through the first seat to arrive at the second seat, and the second fracture is created before the first ball lands onto the first seat.

6. The method of claim 1, further comprising:

after curing of the cement slurry, deploying a ball through the liner string to the first seat, wherein ball lands onto the first seat and opens the first fracture valve.

7. The method of claim 6, wherein:

the ball is deployed to the first seat by pumping fracturing fluid, and pumping of the fracturing fluid is continued, thereby forcing the fracturing fluid through the open first fracture valve and the cured cement and into the productive formation by creating respective a fracture.

8. The method of claim 7, wherein:

the liner string further comprises a liner hanger, a packer, and a toe sleeve, and the method further comprises:

setting the liner hanger before the cement slurry is pumped; and setting the packer after the cement slurry is pumped; and the toe sleeve opens in response to pumping of the ball.

9. A method of fracturing a productive formation, comprising:

deploying a liner string into a wellbore to a portion of the wellbore traversing the productive formation using a workstring, the liner string comprising a first cluster valve and the workstring comprising a first wiper plug;

pumping cement slurry into the workstring;

pumping a dart through the workstring, thereby driving the cement slurry into the liner string, wherein:

the dart engages the first wiper plug and releases the first wiper plug from the workstring, the dart and engaged first wiper plug drive the cement slurry through the liner string and into an annulus formed between the liner string and the wellbore, the dart and engaged first wiper plug land onto the first cluster valve, the first wiper plug releases the dart, and the dart engages a second wiper plug connected to the first cluster valve and releases the second wiper plug from the first cluster valve; and deploying a ball through the liner string to the first cluster valve, wherein:

the ball lands onto the first wiper plug and opens the cluster valve, and the first wiper plug releases the ball.

10. The method of claim 9, wherein:

the ball is deployed to the first cluster valve by pumping fracturing fluid, and pumping of the fracturing fluid is continued, thereby forcing the fracturing fluid through the open cluster valve and the cured cement and into the productive formation by creating a fracture.

11. A method of cementing a liner string in a wellbore, comprising:

deploying a liner string into the wellbore, the liner string comprising a first valve;

pumping a cement slurry into the liner string;

pumping a dart and a first wiper plug through the liner string, thereby driving the cement slurry through the liner string;

releasing a first seat from the dart;

landing the dart in a second wiper plug; and releasing the second wiper plug from the first valve.

12. The method of claim 1, further comprising:

landing the dart and the second wiper plug onto a second valve;

releasing a second seat from the dart;

landing the dart in a third wiper plug; and releasing the third wiper plug from the second valve.

13. The method of claim 12, further comprising:

deploying first and second balls through the liner string to the first and second seats;

exerting pressure on the first and second balls to open the first and second valves; and pumping fracturing fluid through the open first and second valves to create first and second fractures.

14. The method of claim 13, further comprising:

deploying the second ball before the first ball, wherein the first ball has a diameter greater than a diameter of the second ball;

pumping the second ball past the first seat to arrive at the second seat; and creating the second fracture before the first ball lands onto the first seat.

15. The method of claim 11, further comprising:

deploying a ball through a liner string to the first seat; and landing the ball onto the first seat to open the first fracture.

16. A method of fracturing a productive formation, comprising:

deploying a liner string into the wellbore, the liner string comprising a first valve;

pumping a cement slurry into the liner string;

pumping a dart and a first wiper plug through the liner string, thereby driving the cement slurry through the liner string;

releasing the dart from a first wiper plug;

landing the dart in a second wiper plug;

releasing the second wiper plug from the first valve;

deploying a ball through the liner string to the first valve;

landing the ball onto the first wiper plug to open the first valve; and releasing the ball from the first wiper plug.

17. The method of claim 16, further comprising:

deploying the ball to the first cluster valve by pumping fracturing fluid; and pumping fracture fluid through the open cluster valve to create a fracture.

18. The method of claim 17, further comprising:

landing the ball onto the second wiper plug to open the second fracture valve; and releasing the ball from the second wiper plug.

19. The method of claim 18, further comprising:

deploying the ball to the second cluster valve by pumping fracturing fluid; and pumping fracture fluid through the open cluster valve to create a fracture.

20. A method of cementing a liner string in a wellbore, comprising:

deploying a liner string into the wellbore, the liner string comprising a first valve and a plug;

pumping a cement slurry into the liner string;

landing a dart in the plug;

releasing the plug and the dart from the first valve;

landing the plug and the dart in a second valve;

releasing the dart from the plug; and landing the dart in a second plug.

21. The method of claim 20, further comprising, releasing the second plug and the dart from the second valve.

22. The method of claim 21, further comprising:

landing the second plug and the dart in a third valve; and releasing the dart from the second plug.

23. The method of claim 22, further comprising, fracturing the third valve.

24. The method of claim 23, further comprising, fracturing the second valve after fracturing the third valve.

25. The method of claim 24, further comprising, fracturing the first valve after fracturing the second valve.

* * * * *